US009689116B2

(12) United States Patent
Hughes

(10) Patent No.: US 9,689,116 B2
(45) Date of Patent: Jun. 27, 2017

(54) RAIL TRACK SLEEPER SUPPORT

(75) Inventor: Jim Lawson Hughes, Martin (AU)

(73) Assignee: NEWSTYLE NOMINEES PTY LTD., Martin, Western Australia (AU)

( * ) Notice: Subject to any disclaimer, the term of this patent is extended or adjusted under 35 U.S.C. 154(b) by 433 days.

(21) Appl. No.: 14/110,038

(22) PCT Filed: Apr. 5, 2012

(86) PCT No.: PCT/AU2012/000356
§ 371 (c)(1),
(2), (4) Date: Dec. 12, 2013

(87) PCT Pub. No.: WO2012/135913
PCT Pub. Date: Oct. 11, 2012

(65) Prior Publication Data

US 2014/0183271 A1 Jul. 3, 2014

(30) Foreign Application Priority Data

Apr. 5, 2011 (AU) ..... 2011901253
Apr. 11, 2011 (AU) ..... 2011901348

(51) Int. Cl.

| | |
|---|---|
| ***E01B 1/00*** | (2006.01) |
| ***E01D 19/12*** | (2006.01) |
| ***E01B 37/00*** | (2006.01) |
| ***E01B 2/00*** | (2006.01) |
| ***E01B 19/00*** | (2006.01) |
| *E01B 27/04* | (2006.01) |

(52) U.S. Cl.
CPC ..... *E01B 1/008* (2013.01); *E01B 1/00* (2013.01); *E01B 1/002* (2013.01); *E01B 2/003* (2013.01); *E01B 19/00* (2013.01); *E01B 37/00* (2013.01); *E01D 19/12* (2013.01); *E01B 27/04* (2013.01)

(58) Field of Classification Search
CPC ..... E01B 1/002; E01B 1/004; E01B 1/008
USPC ..... 238/2, 7
See application file for complete search history.

(56) References Cited

U.S. PATENT DOCUMENTS

| | | | | | |
|---|---|---|---|---|---|
| 667,396 | A * | 2/1901 | Ireland | A63H 19/30 | 238/272 |
| 3,289,941 | A * | 12/1966 | Sonneville | E01B 1/002 | 238/116 |
| 4,616,395 | A * | 10/1986 | Farese | E01B 1/002 | 238/283 |
| 4,696,429 | A * | 9/1987 | Ortwein | E01B 1/001 | 238/2 |
| 4,703,890 | A * | 11/1987 | Tognoli | E01B 1/004 | 104/11 |
| 4,728,032 | A * | 3/1988 | Beigl | E01B 1/002 | 238/2 |

(Continued)

FOREIGN PATENT DOCUMENTS

| | | |
|---|---|---|
| DE | 3906237 | 12/1989 |
| DE | 10133246 | 1/2003 |

(Continued)

*Primary Examiner* — Zachary Kuhfuss
(74) *Attorney, Agent, or Firm* — MH2 Technology Law Group, LLP

(57) ABSTRACT

A support (32) adapted to be used in place of ballast in supporting a rail support member (31) of a rail track comprises a body (50). The body (50) includes a lower face (70) for resting on a support surface, and an upper surface (71) for supporting the rail support member (31).

16 Claims, 24 Drawing Sheets

(56) References Cited

U.S. PATENT DOCUMENTS

| | | | | | |
|---|---|---|---|---|---|
| 4,905,896 | A * | 3/1990 | Eisenmann | E01B 1/004 | 238/2 |
| 5,312,038 | A * | 5/1994 | Merlanti | E01B 1/002 | 238/382 |
| 5,941,482 | A * | 8/1999 | Santagata | E01B 7/24 | 219/541 |
| 6,055,693 | A * | 5/2000 | Lehr | E01B 2/003 | 14/73 |
| 6,237,856 | B1 * | 5/2001 | Bachmann | E01B 1/004 | 238/30 |
| 6,843,181 | B2 * | 1/2005 | Morris | B60M 5/00 | 104/275 |
| 2007/0164125 | A1 * | 7/2007 | Freudenstein | E01B 1/004 | 238/6 |
| 2008/0116290 | A1 * | 5/2008 | Freudenstein | E01B 1/004 | 238/2 |
| 2008/0173724 | A1 * | 7/2008 | Frenzel | E01B 1/001 | 238/2 |
| 2012/0317906 | A1 * | 12/2012 | Hammond | E01B 1/002 | 52/223.7 |
| 2013/0277441 | A1 * | 10/2013 | Laborenz | E01B 1/004 | 238/3 |

FOREIGN PATENT DOCUMENTS

| | | |
|---|---|---|
| EP | 0640718 | 3/1995 |
| EP | 0919666 | 6/1999 |
| EP | 1026320 | 8/2000 |
| WO | 2004/018771 | 3/2004 |

* cited by examiner

RAIL TRACK SLEEPER SUPPORT

CROSS-REFERENCE TO RELATED APPLICATIONS

This application is a U.S. National Stage application of PCT/AU2012/000356 filed 5 Apr. 2012, which claims priority to Australian patent application 2011901253 filed 5 Apr. 2011 and Australian patent application 2011901348 filed 11 Apr. 2001, the entire disclosures of which are hereby incorporated herein by reference in their entireties.

FIELD OF THE INVENTION

The present invention relates generally to rail tracks and, in particular, to rail tracks that include one or more sleepers.

Although the present invention will be described with particular reference to railway tracks, it will be appreciated that it is not necessarily limited to being employed with such tracks. For example, it could be employed with tram or light rail tracks.

BACKGROUND ART

A traditional railway track structure includes rails, fasteners, sleepers, ballast, and a subgrade which underlies the ballast.

The track ballast is customarily crushed stone whose purpose is to support the sleepers and allow some adjustment of their position, while allowing for water drainage.

Ballast should be strong, hard-wearing, stable, drainable, easy to clean, workable, resistant to deformation, easily available, and reasonably cheap to purchase.

Good quality track ballast is made of crushed natural rock with particles between 28 mm and 50 mm in diameter, a high proportion of particles finer than this will reduce its drainage properties, and a high proportion of larger particles results in the load on the sleepers being distributed improperly. Angular stones are preferable to naturally rounded ones, as angular stones interlock with each other, inhibiting track movement.

Typically, ballast is laid to a thickness of at least 300-400 mm. An insufficient depth of ballast can result in the underlying soil being overloaded and, in the worst cases, the track can sink.

Over time, the ballast of a railway track is crushed into smaller pieces by the weight of trains passing over it. This crushing can make the ballast unstable and when combined with the effects of dust and rain on the ballast can effectively cause the ballast to form a dam wall which is difficult or impossible for water to drain through. As a consequence, water may build-up on one side of an affected railway track, particularly if the track is located on a flood plain which is subjected to flooding.

If water does build-up beside a railway track to a sufficient extent it can push on the ballast of the track with sufficient force to displace the ballast. This in turn can displace the sleepers which are supported by the ballast as well as the rails which are supported by the sleepers so that the track becomes kinked.

Although the track may still be useable if the ballast is crushed or if the track is not too badly kinked, it is usually necessary for trains to reduce their speed so that they can safely negotiate the affected portion of track. For example, a train with empty wagons may have to reduce its speed to as little as 30-35 km/h in order to negotiate the affected portion of track.

To prevent this problem from occurring, ballast should be periodically cleaned and, if necessary, replaced, to ensure that it is able to adequately drain water. However, due to the expense of performing such maintenance, it is often not performed as often as it should, or even at all, in some cases.

The laying of a modern railway track typically involves leveling, grading, and compacting to a specific resistance the ground/subgrade on which the track is to be laid. Geo cloth is then placed on top of the ground, and then a layer of ballast is then placed on top of the cloth. Although water can drain through the ballast, it usually meets resistance when it encounters the geo cloth.

It sometimes happens that part of the foundation of a railway track will be washed away by water such that a channel in which water collects is created beneath the ballast of the track. As a consequence, the ballast above the channel is not properly supported by the foundation. When the wheels of a train pass over this region of the track, they can repeatedly press the part of the track above the channel into the channel and cause water in the channel which contains particles of dirt and other materials to be pumped out on to the track, including the track ballast. This dirty water can contaminate the track which can foul the ballast and prevent it from draining water properly which can lead to water displacing the ballast as described earlier.

Sometimes track ballast will not just be displaced by water it will be completely washed away. When this happens it can result in the affected track being shut down, and can also result in equipment and goods being lost or damaged.

Some railway bridges include a corrugated or channeled steel plate which supports the ballast of a railway track. At the bottom of the corrugations/channels there are drainage holes for allowing water which drains through the ballast into the channels to drain out of the channels so that it does not cause the plate to rust away. Over time, as the ballast is crushed by the weight of trains which pass over it and smaller particles of the ballast fall into the channels along with other material, the drainage holes in the plate become clogged so that water is unable to drain from them properly if at all. Consequently, the plate begins to rust away.

The sleepers of a railway track that are supported by ballast and that are located on a corner of the track are particularly prone to moving/drifting apart as trains pass over them. This is a consequence of the various forces exerted on the track by the trains, as well as the vibrations that they are subjected to.

Railway tracks in sandy environments are prone to being covered by sand. For example, in Saudi Arabia as well as many other Middle Eastern countries, railway tracks are prone to being buried by desert sand which drifts on to the tracks.

Typically, a bulldozer is used to clear the sand from the tracks. However, this can often cause damage to the track, including the sleepers. Moreover, the track can become unaligned, and it is usually not possible to realign the track until all of the sand covering it has been removed.

If the track is of the sleeper rail type, once the track is laid it is virtually impossible to modify or adjust the track in an attempt to try and prevent it from being buried under sand.

Also, in hot environments, the use of ballast to support the sleepers of a railway track can increase the heat of the rails of the track to such an extent that they buckle. In particular, ballast that is used in railway track structures tends to trap heat which can heat the rails that are supported by the sleepers that are in turn supported by the ballast. If the rails are heated to a sufficient extent, they can distort or buckle.

Skilled workers are usually required to lay the ballast of a traditional railway track. This can increase the expense of laying such a track, particularly in times when such workers are hard to come by.

Moreover, the construction of a traditional railway track which includes ballast laid on a subgrade, a plurality of sleepers supported by the ballast, and rails supported by and secured relative to the sleepers can be time consuming and therefore expensive.

In addition, in an effort to prolong their use for as long as possible with as little maintenance as possible, railway tracks are usually laid on good quality land with stable ground, etc. This obviously prevents the land from being used for other more useful purposes such as farming.

Another disadvantage of railway tracks which utilise ballast is that when the track bed becomes uneven, it is necessary to pack ballast underneath sunken sleepers to level the track out against. This operation is usually done by a ballast tamping machine. Tamping the ballast will often increase the overall height of the ballast which can make the ballast less stable.

A further disadvantage of railway tracks which utilise ballast is that, at a railway junction having a switch enabling trains to be guided from one railway track to another, pieces of ballast may become lodged between points or switch rails of the switch and diverging outer rails or stock rails of the junction. Such lodgement may inhibit their movement between required switching positions and in some cases prevent required switching positions from being adopted. This can lead to delays and shut downs on the affected track as the lodged pieces of ballast are removed, and can also result in equipment and goods being lost or damaged and persons being injured or killed if the problem is not identified in sufficient time.

Movement of the points or switch rails of the switch may also be inhibited in cold weather conditions which may result in them freezing and becoming "sticky" or locked.

The heavy demand for maintenance is a significant disadvantage of railway tracks which utilise ballast to support sleepers. In particular, the heavy demand for surfacing/tamping and lining to restore the desired track geometry and smoothness of vehicle running is a significant disadvantage. Weakness of the subgrade and drainage deficiencies also leads to heavy maintenance costs. This can be overcome by using ballastless track. In its simplest form this consists of a continuous slab of concrete with the rails supported directly on its upper surface using a resilient pad which is attached by bolts thereto. Over time, without maintenance (which is often not conducted as regularly as it should because of the costs involved), the bolts may become loose or dislodged, resulting in movement of the pad. This movement can result in the rails becoming unsupported or unstable, which can lead to delays and shut downs on the affected track, and can also result in equipment and goods being lost or damaged and persons being injured or killed.

There are a number of proprietary systems, and variations include continuous in situ placing of a reinforced concrete slab, or alternatively the use of pre-cast pre-stressed concrete units laid on a base layer.

However, ballastless track is very expensive to construct, and in the case of existing railroads requires closure of the route for a somewhat long period. Its whole life cost can be lower because of the great reduction in maintenance requirement. Ballastless track is usually considered for new very high speed or very high loading routes, in short extensions that require additional strength (e.g. a rail station), or for localised replacement in the case of exceptional maintenance difficulties.

It is against this background that the present invention has been developed.

SUMMARY OF THE INVENTION

It is an object of the present invention to overcome, or at least ameliorate, one or more of the deficiencies of the prior art mentioned above, or to provide the consumer with a useful or commercial choice.

Other objects and advantages of the present invention will become apparent from the following description, taken in connection with the accompanying drawings, wherein, by way of illustration and example, a preferred embodiment of the present invention is disclosed.

According to a first broad aspect of the present invention, there is provided a support adapted to be used in place of ballast in supporting a rail support member of a rail track, the support comprising a body, and the body including a lower face for resting on a support surface, and an upper face for supporting the rail support member.

Preferably, the support comprises a block.

Preferably, the body is substantially made from reinforced concrete. It is preferred that the reinforced concrete is reinforced by a reinforcing frame. Preferably, the reinforcing frame includes a plurality of joined reinforcing bars.

Preferably, the body also includes a drainage opening for allowing water or other fluid to flow through the body. It is preferred that the body also includes a pipe or tube that extends through the body and that defines the drainage opening. Preferably, the pipe or tube is secured to the reinforcing frame.

Preferably, the body also includes a securing opening for receiving a securing member so that the securing member is able to secure the support relative to the support surface. Preferably, the securing opening is inclined. It is preferred that the body also includes a tube that extends through the body and that defines the securing opening. Preferably, the tube is secured to the reinforcing frame.

Preferably, the body also includes a lifting lug. It is particularly preferred that the body also includes a depression and that the lifting lug is substantially located in the depression. Preferably, the lifting lug is secured to the reinforcing frame.

Preferably, the body also includes an anchor member for securing an attachment to the body. It is preferred that the anchor member comprises an internally threaded ferrule. Preferably, the anchor member is secured to the reinforcing frame.

Preferably, the body also includes a distance locator bracket.

Preferably, the lower face of the body is substantially flat.

Preferably, the lower face of the body includes a channel. It is preferred that the channel has a V-shaped profile.

In one preferred form, the rail support member comprises a sleeper.

Preferably, the upper face includes a recess for receiving the sleeper. It is preferred that the recess is in the form of a channel.

Preferably, the support also comprises a retaining member for retaining the sleeper in position relative to the body. It is preferred that the retaining member comprises a plate that is secured relative to the body.

Preferably, the support also comprises a sleeper pad for the sleeper to rest on. It is preferred that the sleeper pad comprises a rubber pad.

In an alternative preferred form, the rail support member comprises a component of a rail fastening system, and the upper face includes a recess for receiving the rail support member. Preferably, the rail support member is selected from a group of rail support members comprising: a base plate; a tie plate; and a sole plate of the rail fastening system. It is preferred that the recess comprises an indented portion. Preferably, the indented portion is complementarily shaped to receive the rail support member.

In a preferred form, the indented portion is provided with a plurality of bores, each bore defining a securing opening for receiving a securing member to secure the rail support member received in the indented portion. Preferably, the bore is provided with an insert for engaging with the securing member. In a preferred form, the bore comprises locking means for locking the securing member.

Preferably, the support comprises heating means. In a preferred form, the heating means comprises a pyrotechnic heating cable or element encased in the body of the support.

According to a second broad aspect of the present invention, there is provided a mould for forming the body of the support according to the first broad aspect of the present invention.

According to a third broad aspect of the present invention, there is provided a method for constructing the support according to the first broad aspect of the present invention, the method comprising the steps of:

positioning reinforcing in a mould of the body of the support;

pouring wet concrete into the mould such, that the concrete substantially encases the reinforcing;

allowing the poured concrete to substantially set so that it forms the body and is reinforced by the reinforcing; and removing the substantially set and reinforced concrete body from the mould.

According to a fourth broad aspect of the present invention, there is provided a method for replacing ballast that supports a rail support member of a rail track with the support according to the first broad aspect of the present invention, the method comprising the steps of:

removing the ballast; and placing the support underneath the rail support member so that the lower face of the body of the support rests on a support surface, and so that the rail support member rests on the upper face of the body.

According to a fifth broad aspect of the present invention, there is provided a rail track structure, the structure comprising the support according to the first broad aspect of the present invention, a rail support member supported by the support, and a rail supported by and secured relative to the rail support member.

Preferably, the rail track structure is a railway track structure.

In one preferred form, the rail support member comprises a sleeper.

Preferably, the sleeper includes a concrete body. It is particularly preferred that the body is a reinforced concrete body.

Preferably, the sleeper includes a base plate to which the rail is secured relative to. It is preferred that the rail track structure also includes a clip, the base plate includes a rib, and that the rib includes an opening that receives the clip such that the clip secures the rail relative to the base plate.

Preferably, the sleeper also includes a rail pad that supports the rail on the sleeper. It is preferred that the rail pad comprises a rubber pad.

In another preferred form, the rail support member comprises a component of a rail fastening system.

Preferably, the rail support member is selected from a group of rail support members comprising: a base plate; a tie plate; and a sole plate of the rail fastening system.

Preferably, the rail track structure also includes a securing member that secures the support relative to a support surface.

Preferably, the rail track structure also comprises a walkway platform that is secured relative to the support.

It is preferred that the rail track structure also comprises a handrail that is secured relative to the walkway platform.

Preferably, the rail track structure also comprises a cable holder that is secured relative to the support.

Preferably, the rail track structure also comprises an elevating structure for supporting the supports at an elevated position.

According to a sixth broad aspect of the present invention, there is provided a method for constructing the rail track structure according to the fifth broad aspect of the present invention, the method including the steps of:

placing the rail support member of the structure on the support of the structure such that the rail support member is supported by the support;

placing the rail of the structure on the rail support member such that the rail is supported by the rail support member; and securing the rail relative to the rail support member.

According to a seventh broad aspect of the present invention, there is provided a bridge comprising a support according to the first broad aspect of the present invention, a rail support member supported by the support, and a rail supported by and secured relative to the rail support member.

According to an eighth broad aspect of the present invention, there is provided a method for constructing the bridge according to the seventh broad aspect of the present invention, the method comprising the steps of:

placing the support on a support surface of the bridge such that the support is supported by the bridge;

placing the rail support member on the support such that the rail support member is supported by the support;

placing the rail on the rail support member such that the rail is supported by the rail support member; and securing the rail relative to the rail support member.

According to a ninth broad aspect of the present invention, there is provided a rail track system comprising a support according to the first broad aspect of the present invention, a rail support member that is able to be supported by the support, and a rail that is able to be supported by and secured relative to the rail support member.

BRIEF DESCRIPTION OF THE DRAWINGS

In order that the invention may be more fully understood and put into practice, preferred embodiments thereof will now be described with reference to the accompanying drawings, in which.

BEST MODE(S) FOR CARRYING OUT THE INVENTION

Figure 1:
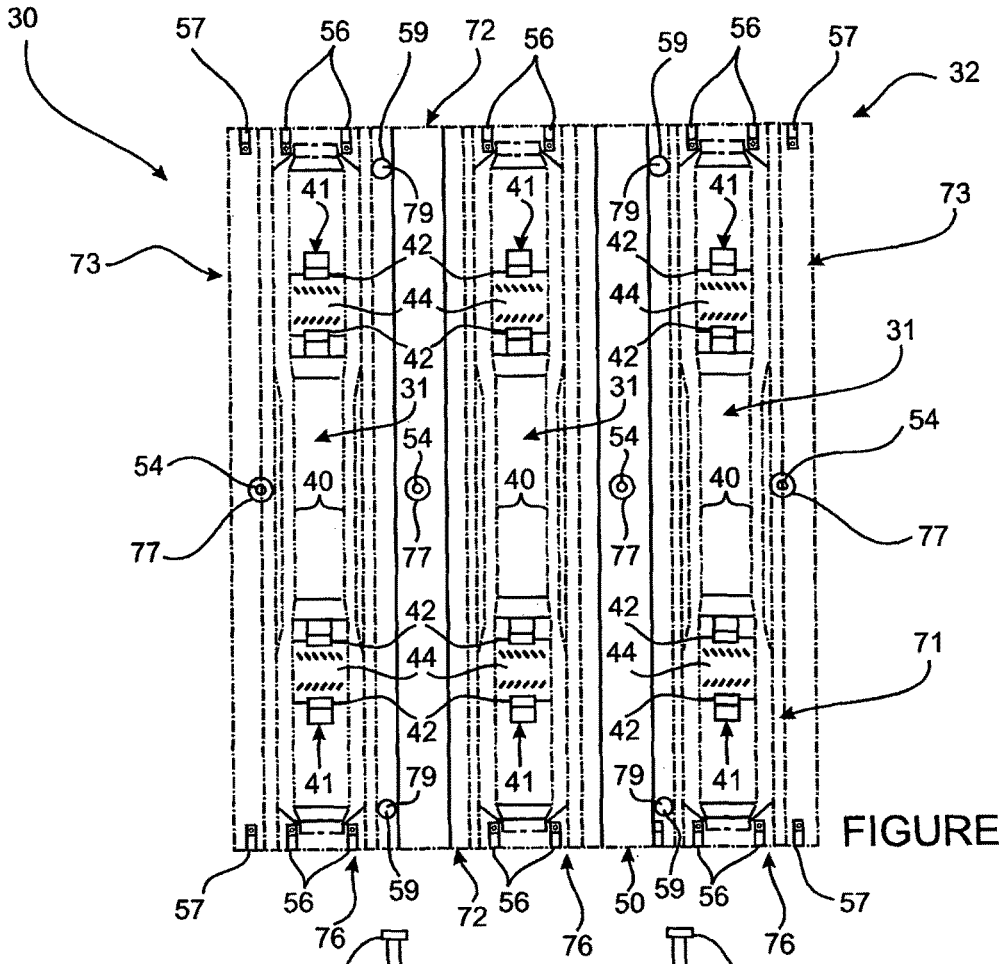
FIG. 1 is a plan view of a portion of a railway track structure that includes a block supporting a plurality of sleepers.
Figure 2:
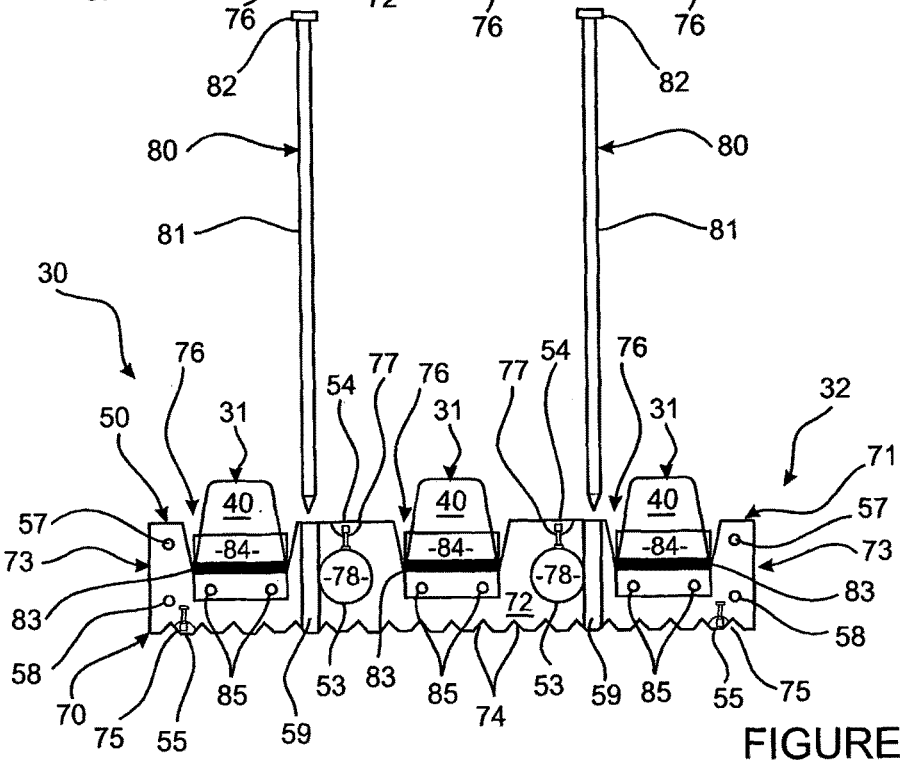
FIG. 2 is a side elevation of the railway track structure portion and a plurality of stakes positioned above the block of the structure.

In the drawings like features of the various embodiments are referenced with like reference numbers Referring to FIGS. 1 and 2, there is depicted a portion of a railway track structure 30. The railway track structure 30 includes a plurality of sleepers 31 for supporting a rail (not depicted) of the structure 30, and a support in the form of a block 32 which is adapted to support the sleepers 31 on a support surface in place of ballast, such as stone ballast, which is widely used to support the sleepers of rail tracks such as railway tracks. This support block 32 may be provided under the trade mark FLOODPLAIN™.

Each sleeper 31 includes a reinforced concrete body 40 to which base plates 41 are secured relative to. Each base plate 41 includes a pair of ribs 42, and each rib 42 includes an opening 43 (see FIGS. 11 and 13) for receiving a clip (see FIGS. 17 to 19) such as a Pandrol™ clip for securing a rail relative to the base plate 41 and, therefore, the sleeper body 40. Such clips are able to prevent the rail from moving upwardly relative to the sleepers 31, but provide no or only limited resistance to lateral movement or twist of the rails. A respective rubber rail pad 44 for supporting a respective rail rests on the body 40 between each pair of ribs 42. The pads 44 are able to function as shock absorbers to reduce jarring on the rails as a train passes along them.

Figure 3:
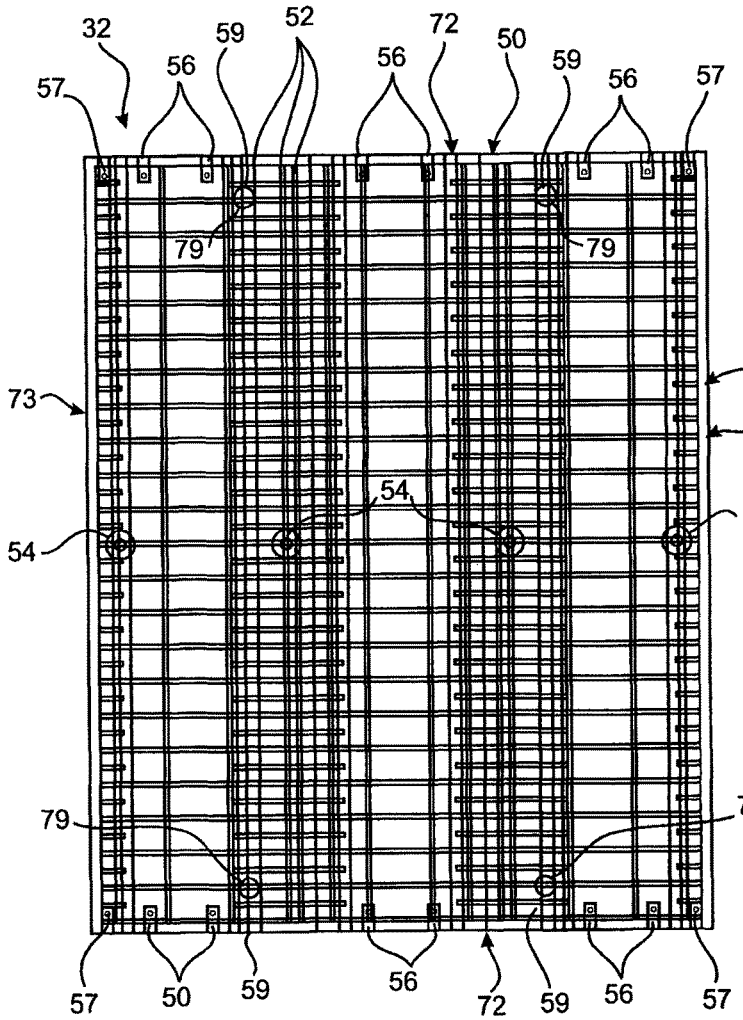
FIG. 3 is a plan view of the reinforced concrete body of the block which depicts the internal reinforcing frame of the body.
Figure 4:
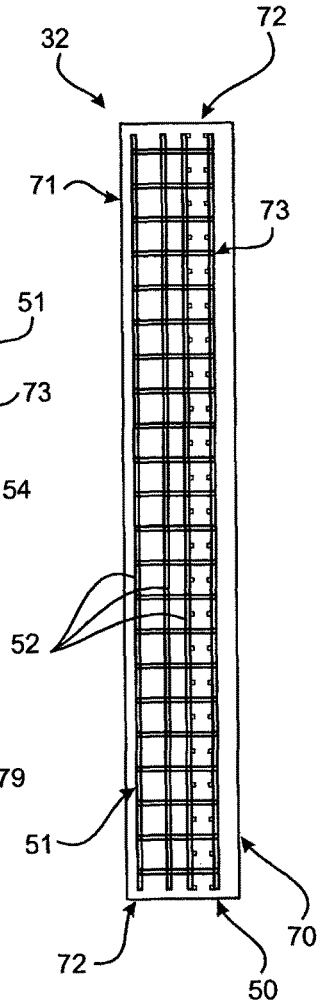
FIG. 4 is an end elevation of the reinforced concrete body depicted in FIG. 3.
Figure 5:
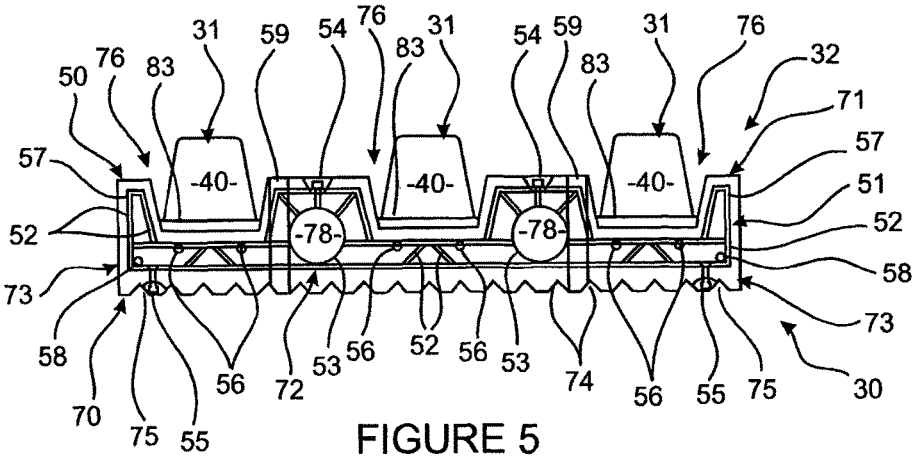
FIG. 5 is a side elevation of the reinforced concrete body depicted in FIG. 3 supporting the sleepers of the railway track structure.

Block 32 includes a reinforced concrete body 50 which is reinforced by an internal steel reinforcing frame 51 (see FIGS. 3 to 5). The reinforcing frame 51 includes a plurality of horizontal, vertical, and inclined reinforcing bars 52 that extend longitudinally and transversely. The reinforcing bars 52 are secured/joined to each other such that the bars 52 collectively form the reinforcing frame 51.

Two or more horizontal cylindrical steel drainage pipes 53 are secured to the frame 51 so that the pipes 53 extend transversely across and through the frame 51.

A plurality of steel lifting lugs 54 and 55 are secured to the frame 51. The lifting lugs 54 are also secured to the pipes 53. The lifting lugs 54, 55, as their name suggests, can be used to lift and position the block 32.

A plurality of anchor members in the form of internally threaded steel ferrules 56, 57, 58 are secured to opposite sides of the frame 51.

A plurality of vertically upstanding cylindrical steel tubes 59 are secured to the frame 51 such that a first pair of the tubes 59 is located adjacent a first side of the body 50, and such that a second pair of the tubes 59 is located adjacent to a second side of the body 50.

The bars 52 and various other components, including the drainage pipes 53, lifting lugs 54 and 55, ferrules 56, 57, and 58, and the tubes 59 may be joined/secured to each other by welding them to each other.

The body 50 is constructed by firstly positioning the reinforcing frame 51 and the various components 53 to 59 that are secured to the frame 51 in a mould (not depicted) of the body 50. Wet concrete is then poured into the mould such that the concrete substantially encases the frame 51 and its attached components 53 to 59. Care is taken when pouring the concrete into the mould so that the concrete does not enter the pipes 53, tubes 59, or cover the internally threaded openings in the ferrules 56, 57, 58. After being poured, the concrete is allowed to set so that it forms the body 50 and is reinforced by the frame 51. Once the concrete has set, the reinforced concrete body 50 is removed from the mould.

The concrete body 50 includes a lower face 70, an upper face 71, a pair of opposed side faces 72, and a pair of opposed end faces 73.

The reinforcing frame 51 is spaced apart from each of the side faces 72 by approximately 50 mm, and is spaced apart from each of the end faces 73 by approximately 30 mm to prevent rust/oxidation damage to the frame 51, and, in particular, its reinforcing bars 52.

The lower face 70, which is substantially flat, includes a plurality of parallel channels 74 which extend transversely across the body 50. Each channel 74 has a V-shaped profile.

The channels 74 provide for the lower face 70 to better grip the support surface on which the block 32 rests so that the block 32 is less prone to moving relative to that surface. They also provide paths for water to flow underneath the block 32 to relieve water pressure on the block 32 in the event of flooding.

The lower face 70 also includes a plurality of depressions 75. Each lifting lug 55 is located in a respective one of the depressions 75. Each lifting lug 55 extends downwardly to a point just below a lip of the depression 75 in which it is located.

The upper face 71 includes a plurality of recesses in the form of channels 76 which extend transversely across the body 50. The channels 76 may be any distance apart from each other. For example, the distance between the centres of the channels 76 may be 600 mm, 650 mm, or 700 mm.

The inventor is aware of twenty-two different sized sleepers that exist worldwide, and that sleepers having three of those sizes are presently used in the construction of railway tracks in Australia. The dimensions of the block 32 and the channels 76 can be selected so that the channels 76 are able to accommodate sleepers of any length or width.

The upper face 71 also includes a plurality of depressions 77. Each lifting lug 54 is located in a respective one of the depressions 77. Each lifting lug 54 extends upwardly to a point just below a lip of the depression 77 in which it is located.

The side faces 72 and end faces 73 of the body 50 are all substantially flat.

The ferrules 56, 57, 58 that are secured to the reinforcing frame 51 are exposed on each of the side faces 72.

Each of the pipes 53 defines a drainage opening 78 for water, sand, or other loose material to flow/pass through.

Each of the tubes 59 defines a securing opening 79 for receiving a securing member so that the block 32 is secured relative to a support surface on which the lower face 70 rests. Securing the block 32 in this way inhibits the block 32 from moving relative to the support surface.

Where the support surface is relatively soft, the securing member may be in the form of a stake/lock down pin 80 such as those shown in FIG. 2. The stakes/lock down pins 80 are able to be driven into the support surface through the securing openings 79 in the body 50 so as to secure/lock the block 32 and therefore the track structure 30 in position relative to the support surface. For example, the stakes/lock down pins 80 may be driven deep into the ground with a pile driver. Each stake/lock down pin 80 includes a pointed shank 81 and an enlarged head 82. The enlarged head 82 is wider than each opening 79 and thereby limits the extent to which the stake/lock down pin 80 can be driven into the support surface.

Alternatively, rather than being in the form of a stake/lock down pin 80, the securing member may be in the form of a picket such as, for example, a star picket (not depicted).

Bolts (not depicted) instead of stake/lock down pins 80 or pickets may be used to bolt the block 32 relative to the support surface. For example, bolts may be used to secure the block 32 relative to a support surface of a bridge (not depicted).

Each sleeper 31 is located in a respective one of the channels 76 so that the sleepers 31 are inhibited from moving apart from each other. Each end of each sleeper 31 rests on top of a respective rubber sleeper pad 83 which in turn rests on the upper face 71 of the body 50. In this way, the sleeper pads 83 are located or sandwiched between the sleepers 31 and the blocks 32. The pads 83 are able to function as shock absorbers to reduce jarring on the sleepers 31 as a train passes over them.

A respective retaining member in the form of a retaining plate 84 is located at each end of each channel 76. The retaining plates 84 are secured to the body 50 of the block 32 by bolts 85 that are screwed in to the internally threaded ferrules 56. The retaining plates 84 function to retain the sleepers 31 in position relative to the body 50 and prevent the sleepers 31 from sliding out of the channels 76.

The channels 76 combined with the retaining plates 84 are able to prevent or inhibit relative movement between the sleepers 31.

Figure 27:
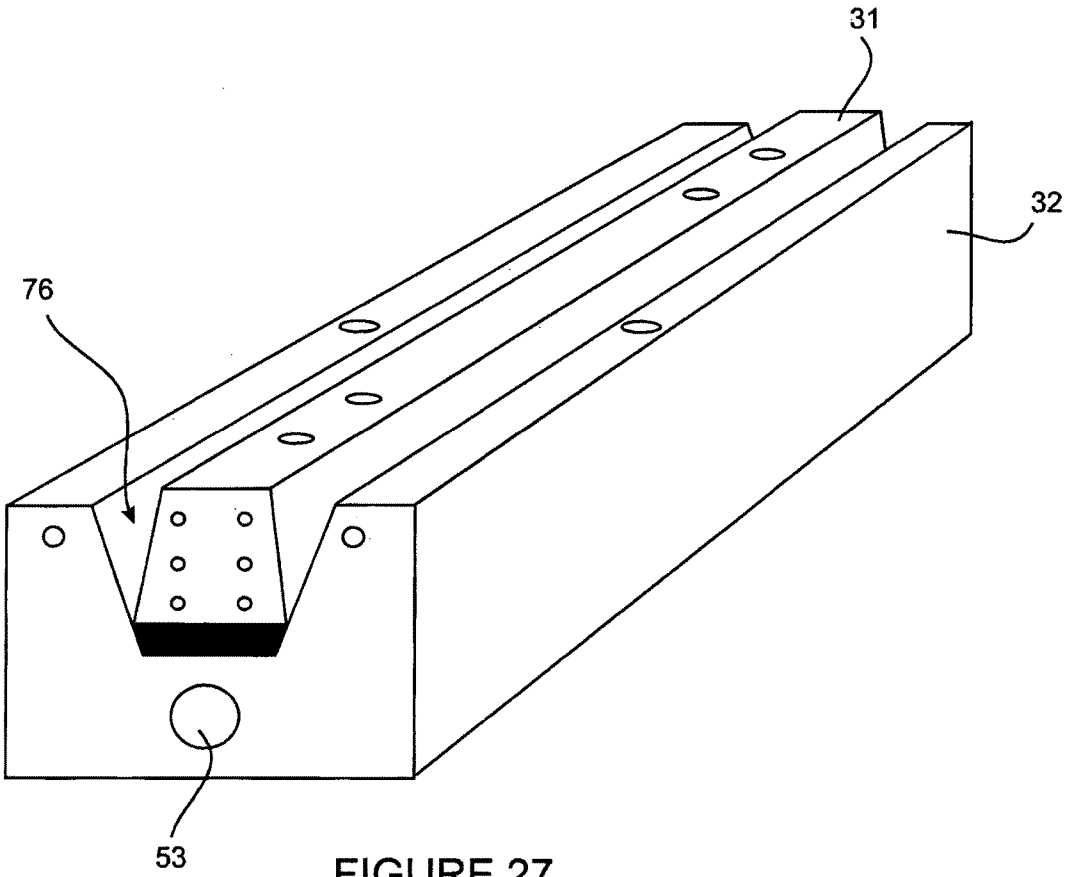
FIG. 27 is a perspective view of an alternative embodiment of a block supporting a sleeper.
Figure 28:
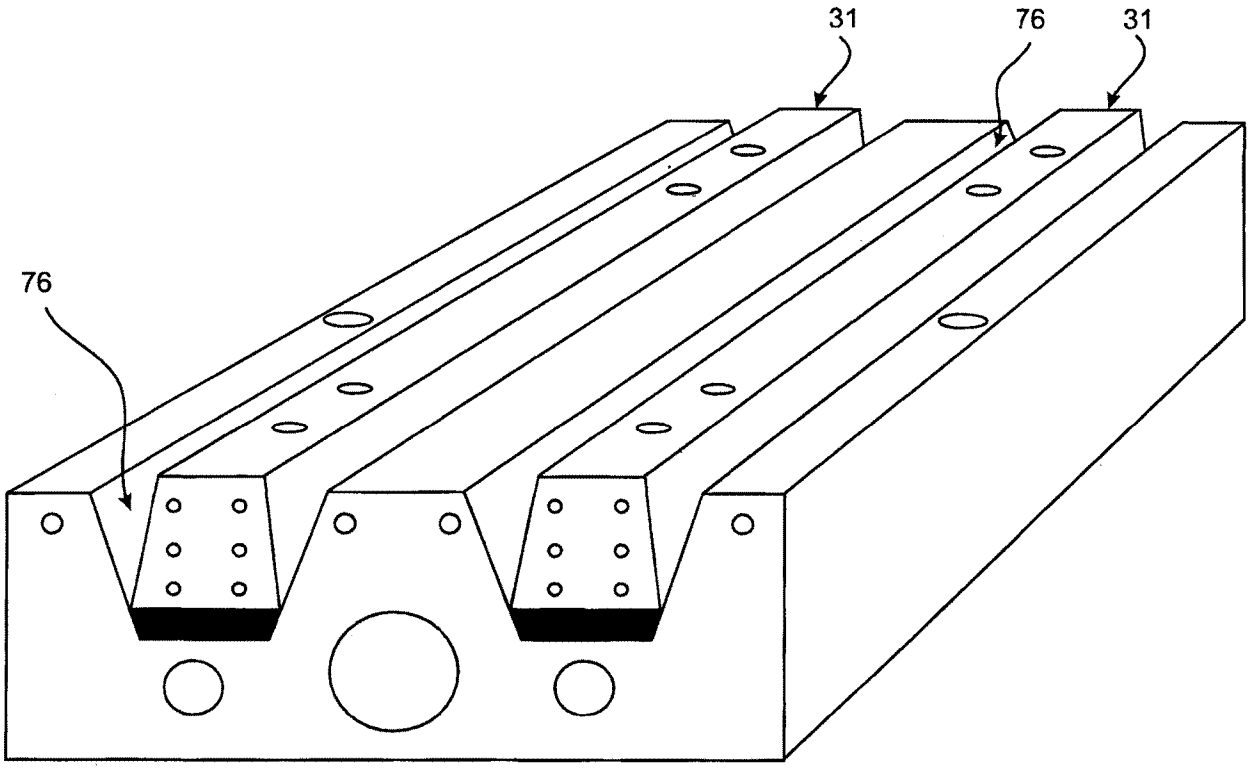
FIG. 28 is a perspective view of another embodiment of a block supporting a pair of sleepers.

Although the block 32 is depicted as having only three channels 76, it can include any number of channels 76. For example, in some embodiments the block 32 may have only one channel 76 and support only one sleeper 31 as depicted in FIG. 27, or the block 32 may have two channels 76 and support two sleepers 31 as depicted in FIG. 28. However, if the block 32 has any more than three channels 76, it can be too difficult or impossible to lift the block 32 with a typical forklift when sleepers 31 are positioned in the channels 76. The depicted block 32 weighs approximately 1.6 tons without sleepers 31 in the channels 76, and about 2.2 tons with sleepers 31 supported in the channels 76.

The block 32 can be made to any dimension to suit the particular conditions that the block 32 is expected to be subjected to.

Where the block 32 is to be used on a flood plain, it can be made so that it is more resistant to being displaced by flood water.

Figures 6, 7, 8:
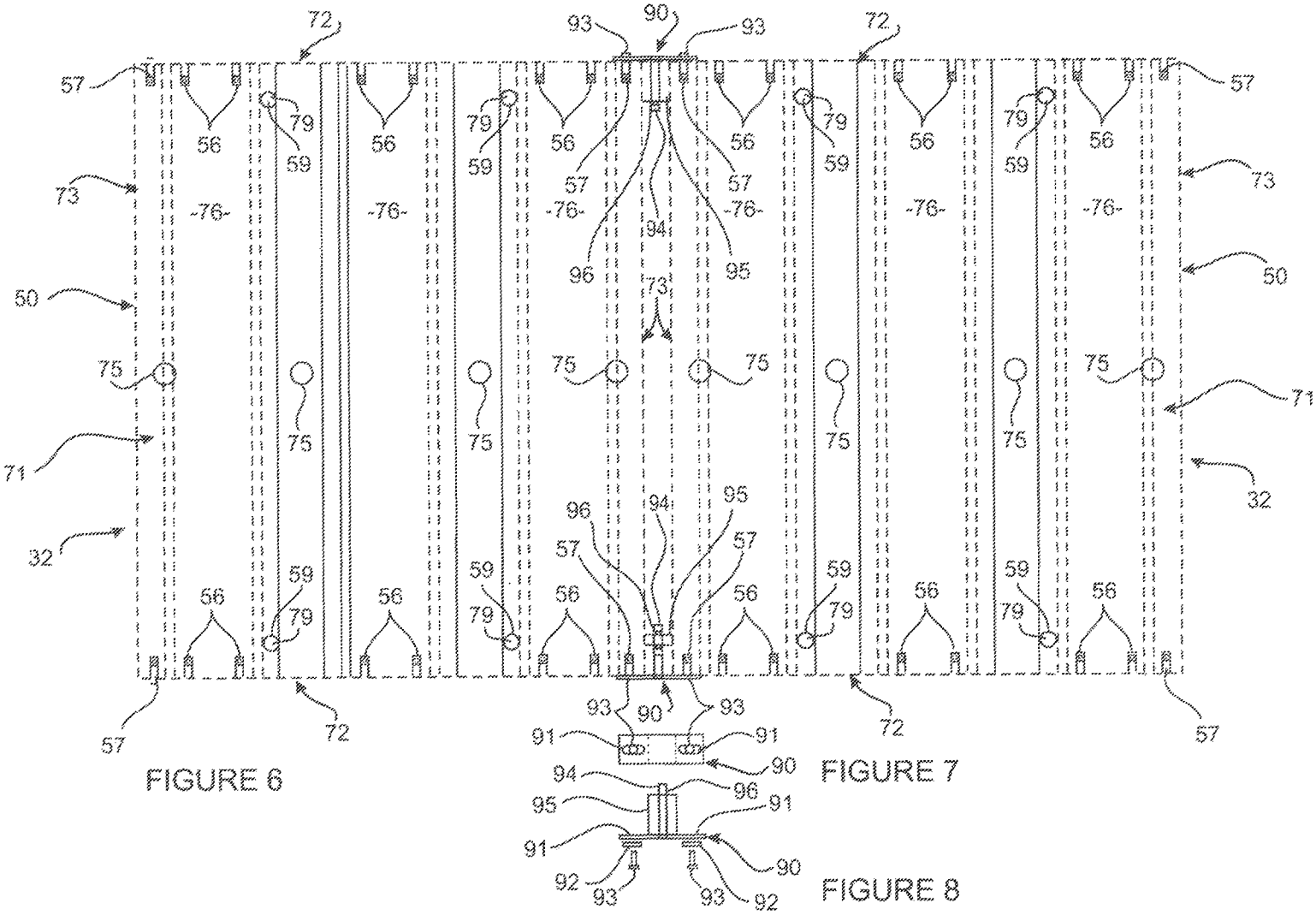
FIG. 6 is a plan view of a pair of blocks that are positioned end to end and that are joined to each other by a pair of plates.
FIG. 7 is a side elevation of one of the plates.
FIG. 8 is a partially exploded plan view of the plate, the rubber block which is secured to the plate, and the inserts and bolts which are used to secure the plate to the blocks illustrated in FIG. 6.

Referring to FIG. 6, a plurality of the blocks 32 may be positioned end to end and then secured to each other by securing a pair of steel plates 90 to each block 32. A pair of elongate openings 91 extends through each plate 90. Each opening 91 receives a respective hollow insert 92, and a respective bolt 93 is inserted into each insert 92. The bolts 93 are screwed into the internally threaded ferrules 57 of the adjacent blocks 32 so that the blocks 32 are thereby secured together.

The inserts 92 allow a small amount of relative longitudinal movement between the blocks 32 so as to prevent the bolts 93 from breaking/shearing if the blocks 32 move relative to each other after they have been secured together.

A respective threaded shaft 94 extends from each plate 90. Each shaft 94 extends through a respective hollow rubber block 95. A respective nylon lock nut 96 is screwed on to the end of each shaft 94 so that the rubber blocks 95 are secured to the plates 90. Each rubber block 95 is positioned between the adjacent blocks 32 so that it is able to function as a resilient spacer/shock absorber between the blocks 32. The adjacent blocks 32 are spaced apart from each other by 100 mm so that that the blocks 95 can be accommodated between the blocks 32. The gaps between the adjacent blocks 32 are able to compensate for expansion and contraction of the blocks 32, as well as relative movement between the blocks 32.

In other embodiments, one or more pneumatic compression pieces (not depicted) may be placed between the adjacent blocks 32 to provide a similar function as the rubber locks 95.

The plates 90 may be made in a variety of lengths so that a variety of different spacing distances between the joined blocks 32 can be achieved. Where the joined blocks 32 are located on a corner of a track, shorter plates 90 may be used to join the sides of the blocks 32 that are on the inside of the corner, and longer plates 90 may be used to join the sides of the blocks 32 on the outside of the corner. Different corner radiuses can be achieved by using plates 90 of various lengths.

Figure 9:
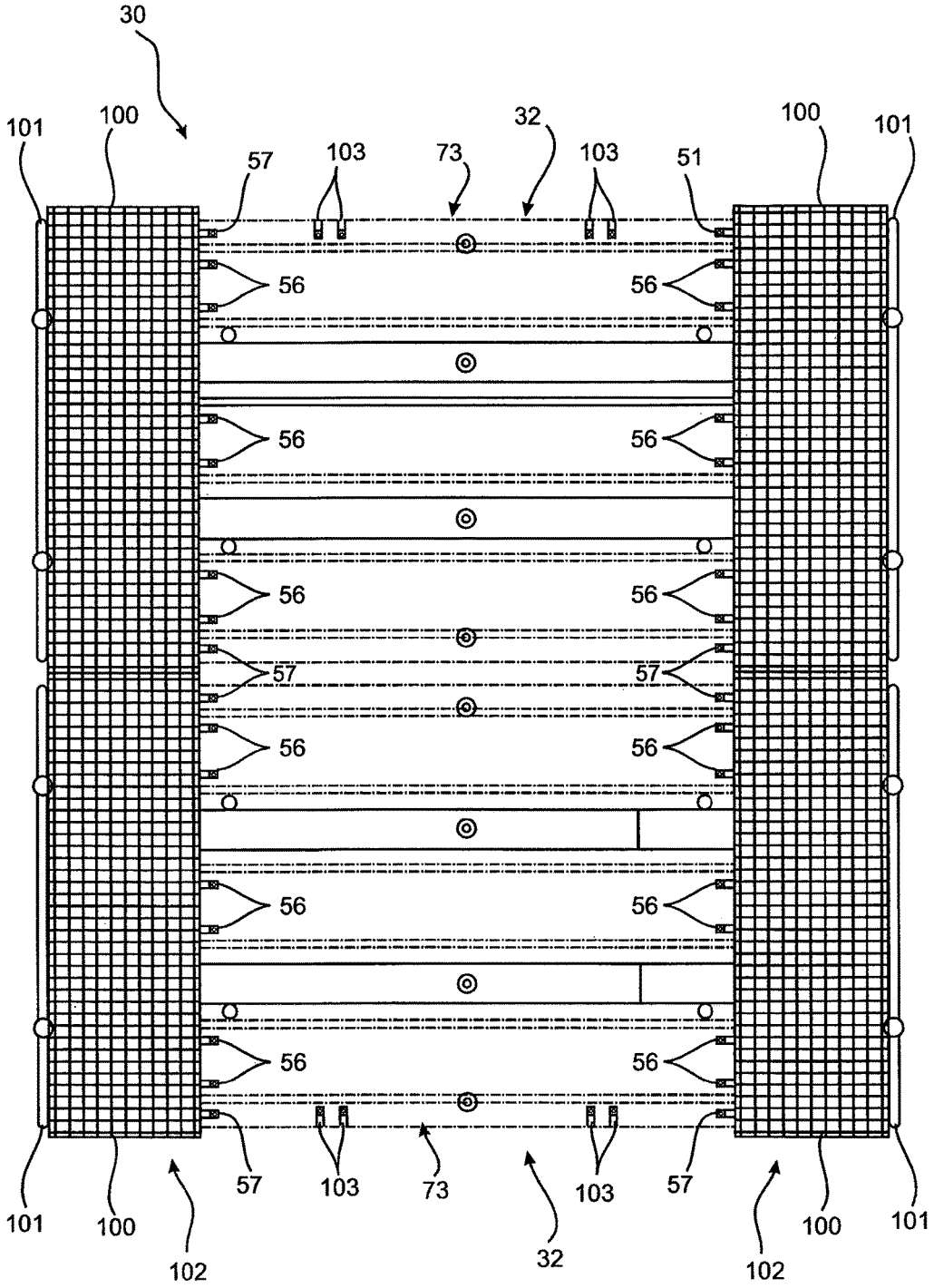
FIG. 9 is a plan view of a portion of a railway track structure that includes a pair of joined blocks and a plurality of walkway platforms that are secured to the blocks.

FIG. 9 shows a portion of a railway track structure 30 that includes a pair of blocks 32 that have been positioned end to end and secured to each other. A plurality of galvanised steel walkway platforms 100 are secured relative to the blocks 32. A respective galvanised steel safety rail/hand rail 101 is secured to each platform 100. The platforms 100 form a respective walkway 102 on each side of the joined blocks 32. In Australia and other countries, such walkways are required by law.

The blocks 32 depicted in FIG. 9 differ from those previously described in that they each include two groups of four internally threaded steel ferrules 103 that are located at one of the end faces 73. Each group of ferrules 103 includes an upper pair and a lower pair. The ferrules 103 of each group are arranged in a rectangular or square configuration. Only the upper ferrules 103 of each group are visible in FIG. 9. The ferrules 103 are secured to the reinforcing frame 51 of the block 32. For example, the ferrules 103 may be welded to the reinforcing frame 51.

Figure 10:
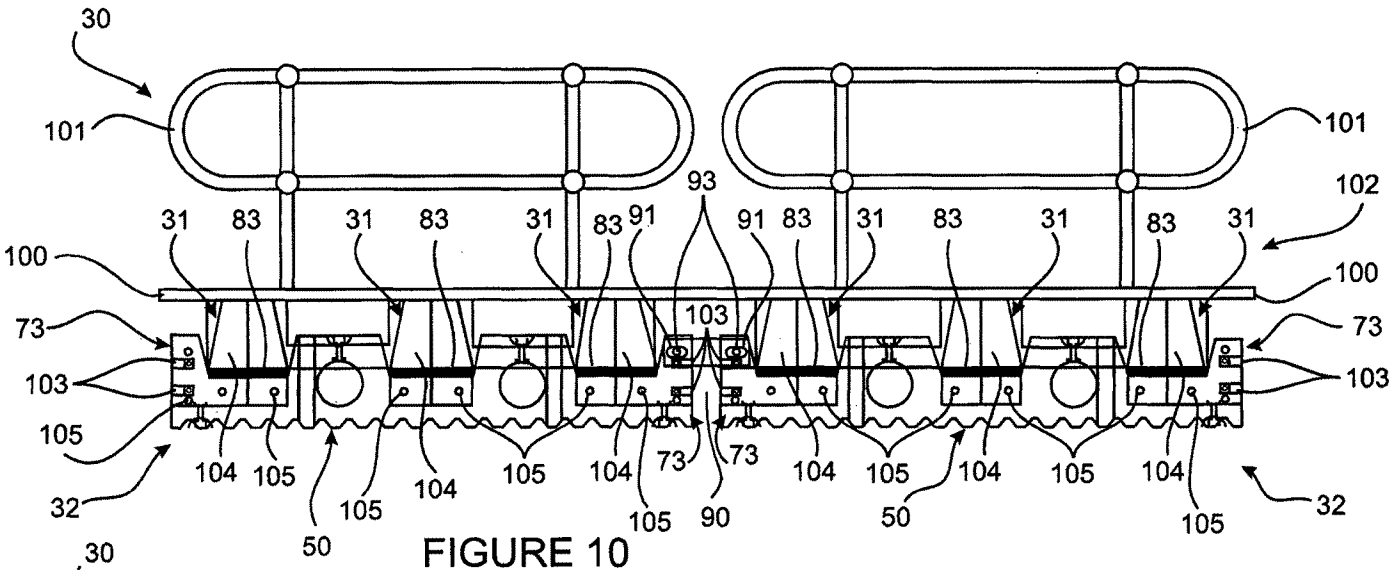
FIG. 10 is a side elevation of a portion of another railway track structure.

FIG. 10 illustrates a railway track structure 30 that includes a pair of adjacent blocks 32 that are joined together by one or more of the plates 90. The blocks 32 differ from those depicted in FIG. 9 in that they each have internally threaded ferrules 103 located at both end faces 73 rather than just one end face 73.

The platforms 100 are secured to brackets 104 which are secured to the blocks 32 by bolts 105 which are screwed in to the ferrules 56 and 58.

Each block 32 supports a plurality of sleepers 31. Each end of each sleeper 31 rests on a respective rubber sleeper pad 83 which is positioned between the sleeper 31 and the upper face 71 of the body 50 of the block 32 which supports the sleeper 31.

Figure 11:
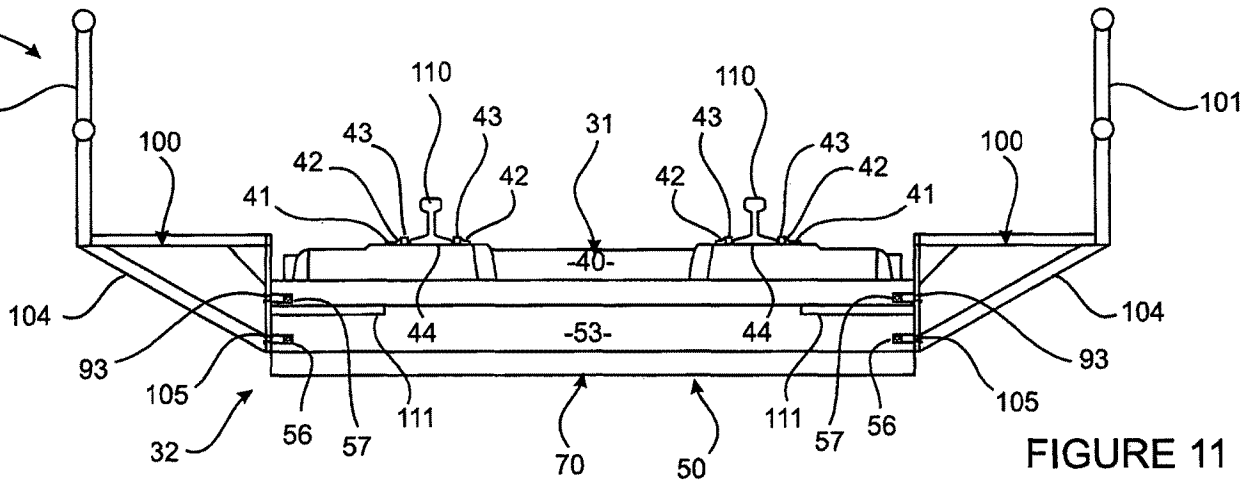
FIG. 11 is a cross-sectional end elevation of the railway track structure depicted in FIG. 10 and a pair of rails supported by the sleepers of the structure.

The railway track structure 30 shown in FIG. 10 is depicted in FIG. 11 with a pair of rails 110 resting on top of/supported by the sleepers 31. A respective rubber rail pad 44 is positioned between each rail 110 and each sleeper 31 such that the rails 110 rest on the pads 44 and such that the pads 44 rest on the sleepers 31.

The brackets 104 that secure the walkway platforms 100 to the body 50 of each block 32 include an elongate member 111 which is made from a suitable metal such as steel. The elongate members 111 are inserted into the drainage openings 78 so that the members 111 press against the uppermost portions of the walls of the drainage pipes 53. In this way, the members 111 are able to assist in distributing the weight of the walkways 102 and the weight of any objects or people standing on the walkways 102 across the body 50.

Figure 12:
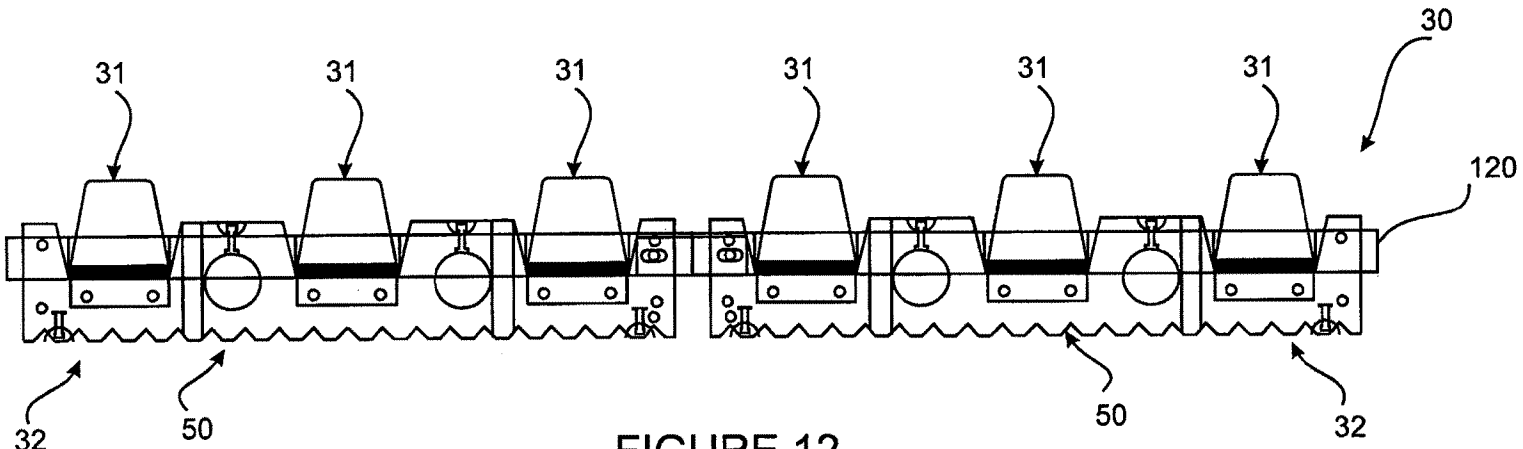
FIG. 12 is a side elevation of a portion of a railway track structure that includes a cable holder secured to the blocks of the structure.

A portion of a railway track structure 30 that is similar to the railway track structure 30 depicted in FIG. 6 and that also includes a pair of cable/pipe holders that are in the form of conduits 120 is depicted in FIG. 12. The conduits 120 can be used to hold one or more signal cables and/or other cables and/or pipes. The conduits 120 are secured to the body 50 of each block 32 of the structure 30.

Figure 13:
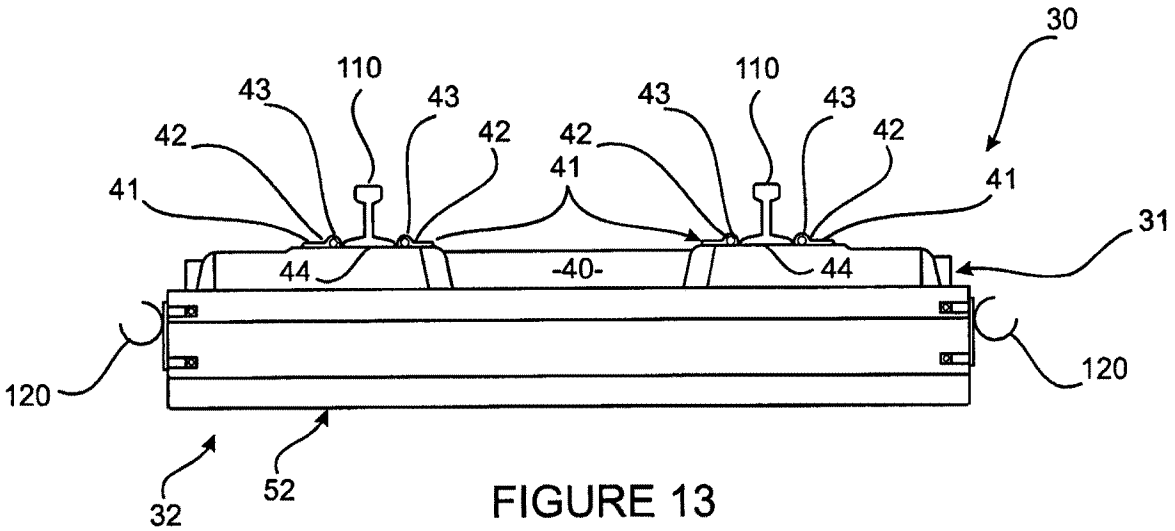
FIG. 13 is an end elevation of the railway track structure depicted in FIG. 12 and a pair of rails supported by the sleepers of the structure.

The railway track structure 30 depicted in FIG. 12 is shown in FIG. 13 with a pair of rails 110 resting on top of/being supported by the sleepers 31. A respective rubber rail pad 44 is positioned between each rail 110 and each sleeper 31 such that the rails 110 rest on the pads 44 and such that the pads 44 rest on the sleepers 31.

Figure 14:
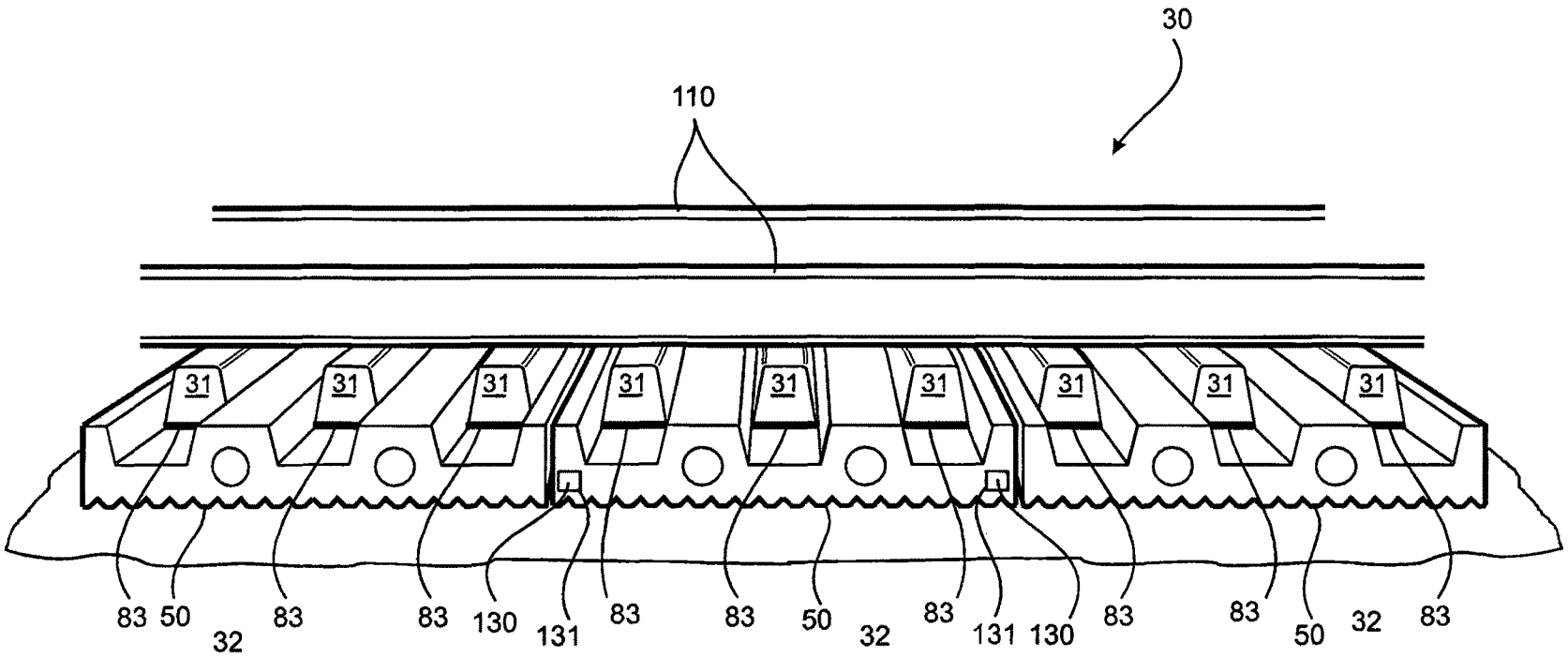
FIG. 14 is a side view of another railway track structure.

Referring to FIG. 14, a railway track structure 30 includes three blocks 32 that are laid or positioned end to end with each other. The blocks 32 support a plurality of sleepers 31 which in turn support a pair of rails 110. The two end blocks 32 are similar to the blocks 32 that have been previously described. However, the middle block 32 also includes a pair of rectangular/square pipes/tubes 130 that define rectangular/square openings 131. The pipes/tubes 130 may be secured to the reinforcing frame 51 by welding or other suitable means. The openings 131 defined by the pipes/tubes 130 may function as drainage openings through which water, sand, or other loose material is able to flow.

Figure 15:
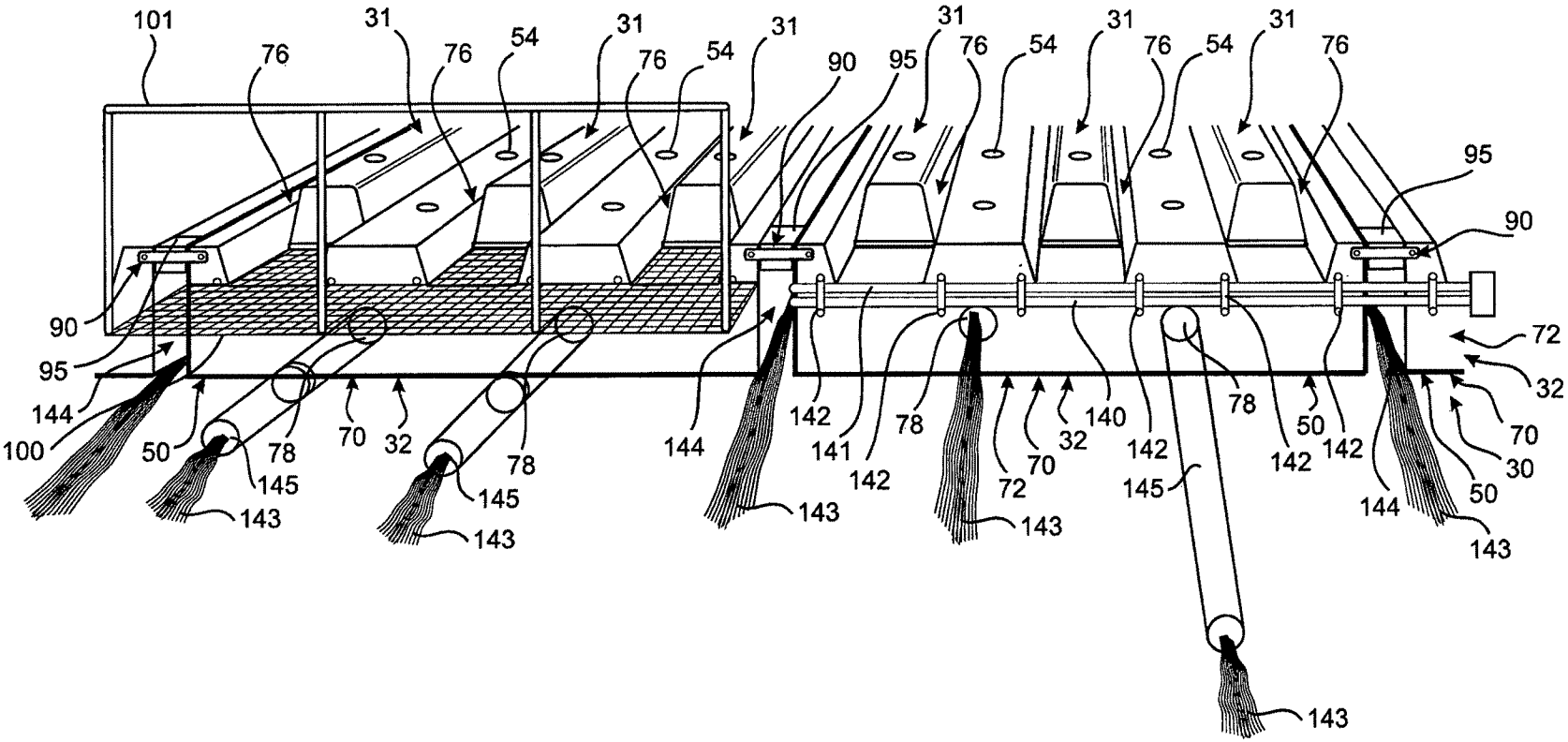
FIG. 15 depicts a railway track structure with pipes or tubes connected to some of the blocks of the structure and with water flowing through the blocks as well as the connected pipes and tubes.

Referring to FIG. 15, a railway track structure 30 includes a plurality of blocks 32 that are laid end to end and that have their lower faces 70 resting on a support surface (not depicted). The blocks 32 could, for example, be laid on a support surface/ground which is located on a flood plain, or they could be laid on a support surface provided by the main structure of a bridge (not depicted).

A plurality of sleepers 31 are supported by the upper faces 71 of the blocks 32. The sleepers 31 are located in the channels 76 of the blocks 32.

The blocks 32 may replace the ballast of an existing railway track, and the sleepers 31 may be the existing sleepers of that track. The ballast may be replaced with the blocks 32 by firstly removing the ballast from around and underneath the sleepers 31 as well as the rails supported by the sleepers 31, and then placing the blocks 32 underneath the sleepers 31 so that the lower face 70 of the body 50 of each block 32 rests on the support surface, and so that the sleepers 31 rest on the upper faces 70 of the bodies 50 of the blocks 32.

The securing openings/lock-down holes 79 of the blocks 32 each have a diameter of 50 mm. The blocks 32 may be secured to the ground or other support surface on which they are supported with securing members in the form of star pickets (not depicted). The star pickets or other securing members are inserted through the openings 79 and driven into the ground.

Alternatively, where the blocks 32 are support by a support surface provided by the main structure of a bridge, securing members in the form of one or more bolts (not depicted) may be inserted through the openings 79 and secured to the main structure.

The blocks 32 are secured to each other by a plurality of plates 90 that are bolted to the blocks 32. Rubber blocks/buffers 95 are secured to the plates 90 and are positioned between the blocks 32 as shown. Each block/buffer 95 is 100 mm long. The plates 90 allow for a small amount of relative sliding movement between the blocks 32.

A walkway platform 100 is secured to one of the blocks 32, and a hand rail/safety rail 101 is secured to the platform 100. The platform 100 may be used, for example, as a passenger walkway.

A cable 140 and a pipe 141 are secured relative to some of the blocks 32 by a plurality of straps/brackets 142 that are secured to the blocks 32. The cable 140 and the pipe 141 are secured relative to the blocks 32 such that they extend along one of the side faces 72 of each of the blocks 32 that they are secured relative to. The cable 140 may, for example, be a fibre optic/IT cable, and the pipe 141 may, for example, be a water pipe.

If, for example, the railway track structure 30 is located on a flood plain or other location which is prone to flooding, flood water 143 is able to make its way past the structure 30 by flowing through the drainage openings 78 in the blocks 32, and by flowing through gaps 144 between the blocks 32 as depicted in FIG. 15. Allowing the water to pass through and between the blocks 32 reduces the force exerted on the blocks 32 by the water which in turn lessens the chances of the blocks 32 being displaced or washed away by the water.

Water which flows through the drainage openings 78 in the blocks 32 may be guided away from the blocks 32 to one or more specific locations by pipes/hoses 145 which are connected to the drainage openings 78 on the downstream side of the blocks 32. The pipes/hoses 145 may, for example, have a diameter of 150 mm, and a length of 50 to 100 meters. The pipes/hoses 145 may be permanently secured to the blocks 32, or they may be detachably secured to them. The water may be transferred by the pipes/hoses 145 to a location where it is or can be stored and/or treated.

Figure 16:
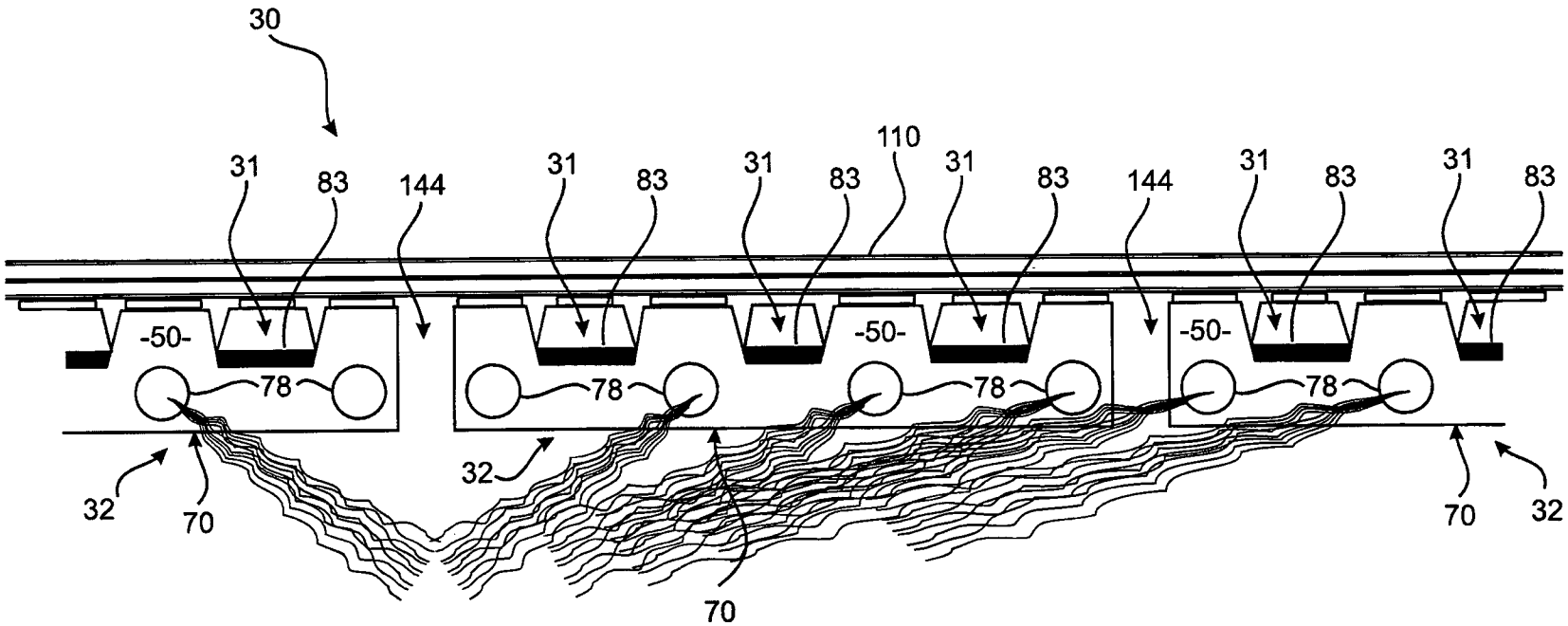
FIG. 16 depicts a railway track structure with water flowing through the drainage openings in the blocks of the structure, and between the blocks.

FIG. 16 depicts a railway track structure 30 in a flood prone area during an extreme flood condition. As can be seen, the flood water 143 is able to flow through the drainage openings 78 in the blocks 32 and the gaps 144 between the adjacent blocks 32. The blocks 32 of the structure 30 are able to provide continuous load support to the rails 110 of the structure 30 despite the flow of water 143 through and between the blocks 32.

The water 143 that passes through the drainage openings 78 and through the gaps 144 between the blocks 32 is able to cool the blocks 32 which are in turn able to cool the rails 110. Cooling the rails 110 in this manner is able to prevent the rails 110 from distorting or buckling in high ambient temperature conditions.

Even when there is no water 143 flowing through the blocks 32, air which passes through the openings 78 is able to cool the blocks 32 and the rails 110 to at least some extent that can prevent or inhibit the rails 110 from distorting or buckling.

The rails 110 are electrically insulated from each other. This allows different electrical signals to be transmitted through each of the rails 110 without the signals interfering with each other. For example, track signaling signals may be transmitted through one of the rails 110, and location signals may be transmitted through the other rail 110.

Figure 17:
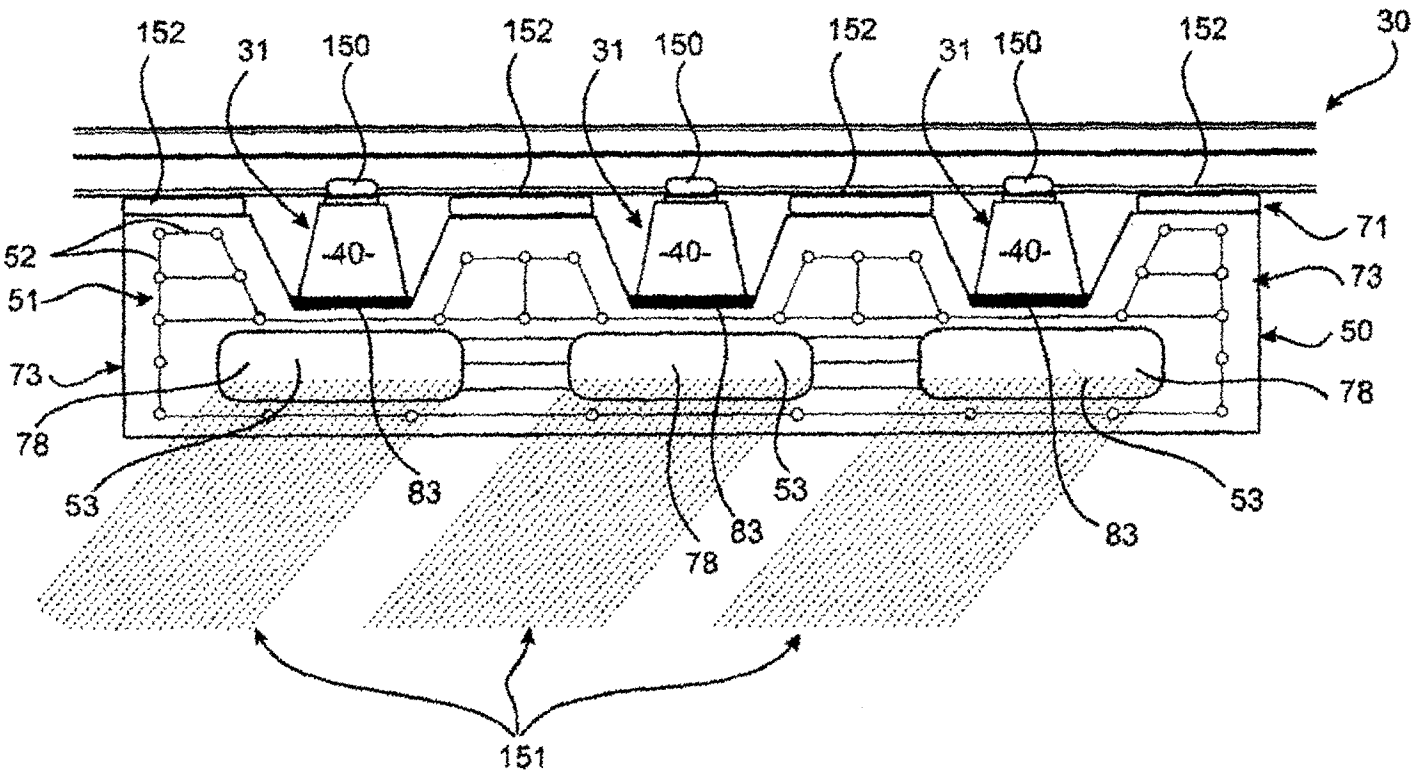
FIG. 17 is side elevation of a railway track structure with sand flowing through the rectangular drainage openings in the block of the structure.

Referring to FIG. 17, a railway track structure 30 includes a block 32 whose body 50 includes rectangular/square/box-section drainage pipes 53 secured to the reinforcing frame 51 of the body 50. The pipes 53 define rectangular openings 78.

The rails 110 of the structure 30 are secured to the base plate ribs 42 of the sleepers 31 by clips 150. The clips 150 may, for example, be Pandrol™ clips.

The structure 30 depicted in FIG. 17 is able to provide substantially continuous load support for the rails 110 of the structure 30. It is able to do this by virtue of the presence of a plurality of rubber rail pads 152 which rest on the upper face 71 of the block 32 and on which the rails 110 rest. The pads 152 support the portions of the rails 110 that are located between the rail pads 44 that rest on top of the sleepers 31.

The block 32 is particularly suitable for use in a sandy environment such as a sandy desert environment where sand can be blown on to railway tracks to such an extent that the sand eventually covers the tracks. The openings 78 in the block 32 allow sand 151 to pass through the block 32 so that the sand 151 is not forced to pass over the top of the railway track where it can cover the rails 110 and obstruct the passage of a train. This support may be provided under the trade mark SANDPLAIN™.

The blocks 32 can be of various heights to elevate the rails 110 sufficiently above the ground to prevent or at least inhibit sand from being blown on top of and covering the rails 110.

The rails 110 of the structure 30 depicted in FIG. 17 are electrically insulated from each other so that each rail 110 is able to carry a different electrical signal.

Figure 18:
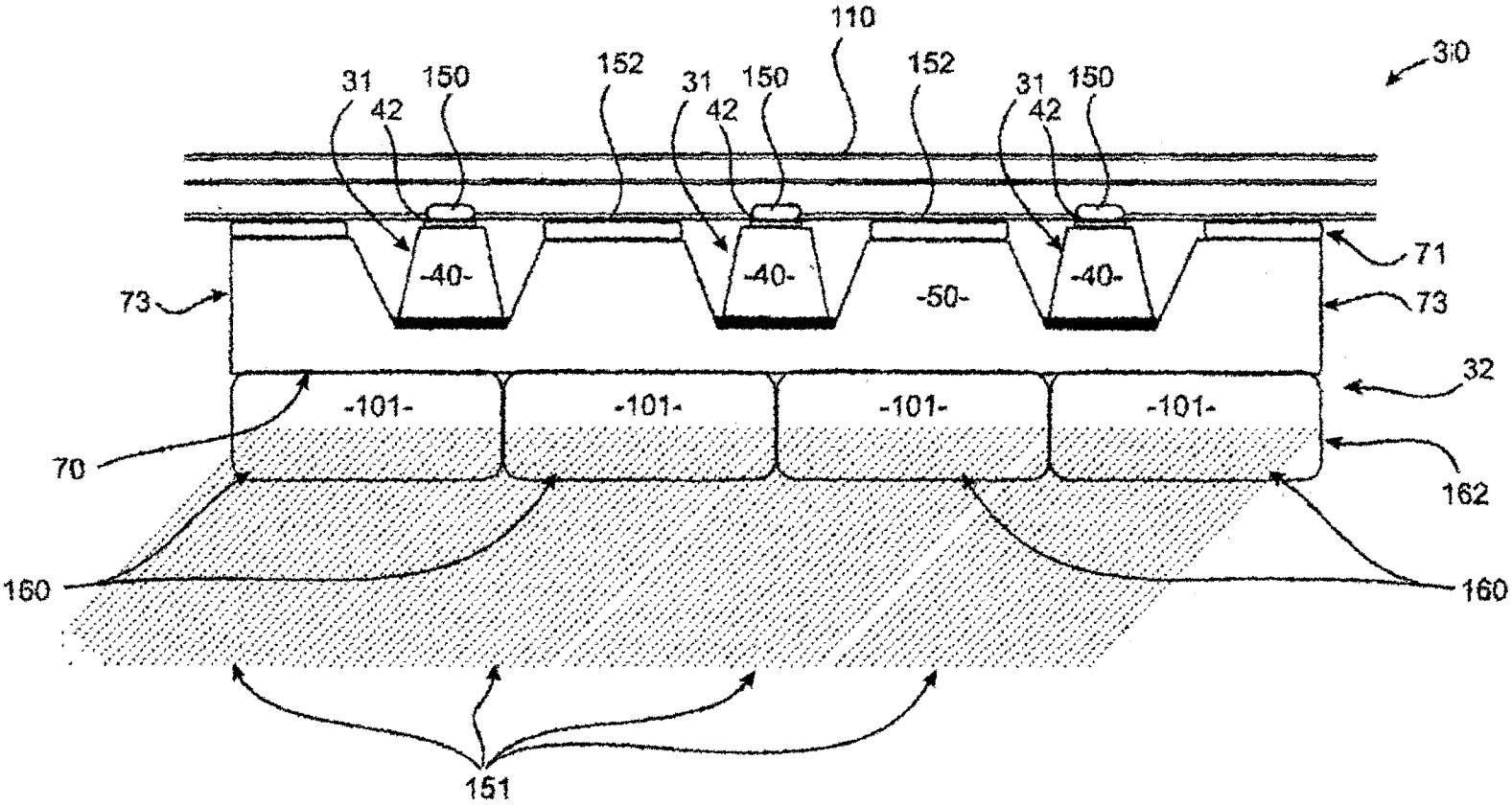
FIG. 18 is a side elevation of a railway track structure with sand flowing through rectangular pipes which support a block of the structure.

Referring to FIG. 18, a railway track structure 30 includes a block 32 which does not including any openings. Instead, the structure 30 includes a plurality of rectangular/box-section pipes 160 which define openings 161. The pipes 160 collectively form an elevating structure 162 which provides a support surface for the lower face 70 of the block 32 to rest on. The pipes 160 in turn rest on a support surface (not depicted) such as the ground.

The structure 30 is particularly well-suited for use in sandy conditions such as sandy desert conditions. The pipes 160 elevate the blocks 32 and rails 110 of the structure 30 above the desert floor to prevent wind from blowing sand over the rails 110 and covering them. Instead, sand 151 is able to be blown by the wind through the openings 161 so that the sand 151 does not cover the rails 110 and obstruct the passage of a train.

The rails 110 of the structure 30 illustrated in FIG. 18 are electrically isolated from each other.

Figure 19:
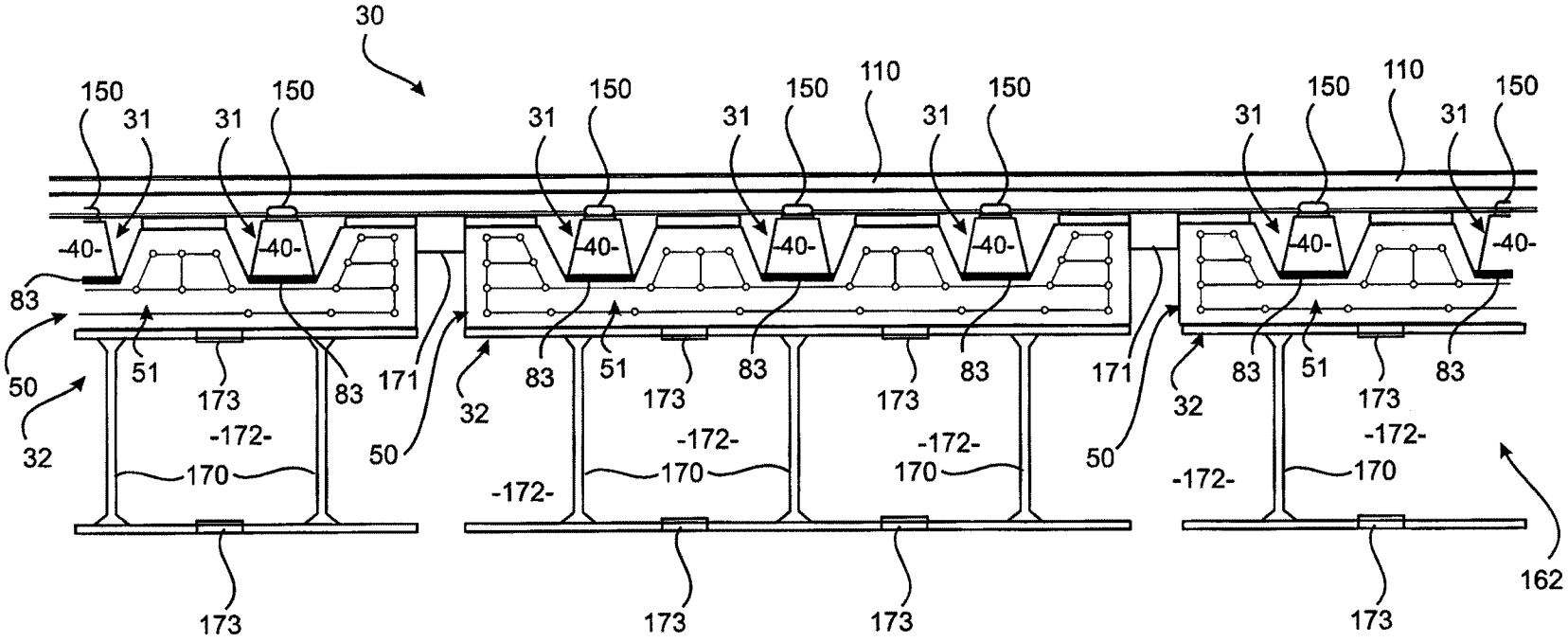
FIG. 19 is a side elevation of a railway track structure that includes a plurality of I-beams supporting a plurality of blocks of the structure.

FIG. 19 depicts another railway track structure 30 which is particularly suitable for use in a sandy environment such as, for example, a sandy desert. The structure 30 includes a plurality of I-beams 170 which elevate and support a plurality of blocks 32 above a support surface such as, for example, the desert floor if the structure is located in a desert environment. In turn, the blocks 32 support a plurality of sleepers 31, and the sleepers 31 support rails 110 which are secured relative to the sleepers by clips 150. The blocks 32 are separated from each other by spacers 171.

The bodies 50 of the blocks 32 do not include any openings for allowing sand to pass through the blocks 32. Instead, the I-beams 170 define a plurality of openings 172 through which sand is able to pass so that it does not build up and cover the rails 110 of the structure 30. The openings 172 are able to function somewhat like wind tunnels in that sand is able to be blown through them by wind.

The minimum distance between the I-beams 170 and therefore the minimum width of the openings 172 is set by adjustment/spacer plates 173 positioned between the flanges of adjacent I-beams 170. The minimum distance between the I-beams 170 can be adjusted by replacing the plates 173 with different sized plates 173.

The I-beams 170 may have various heights and lengths to suit the particular requirements of the structure 30.

The block bodies 50 are made from steel reinforced concrete so that the blocks 32 have the same MPA rating as the sleepers 31 which are reinforced concrete sleepers.

The rails 110 of the structure 110 are also electrically insulated/isolated from each other.

Figure 20:
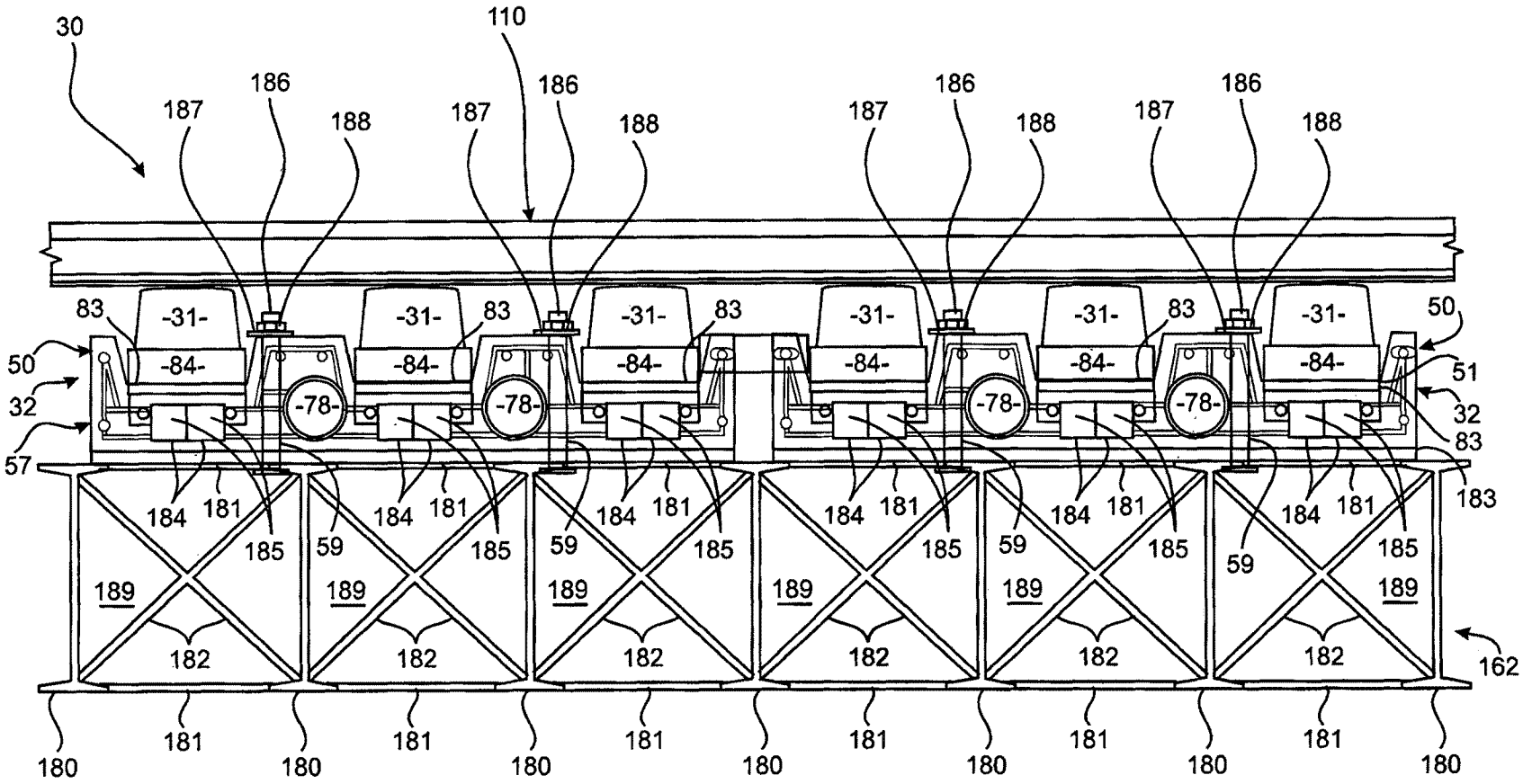
FIG. 20 is a side elevation of a railway track structure that includes a plurality of universal beams supporting a plurality of blocks of the structure.

Referring to FIG. 20 there is shown a railway track support structure 30 that includes a plurality of universal beams 180 between which are a plurality of plates 181 that are welded to the beams 180. A plurality of cross braces 182 extend diagonally between the adjacent beams 180 and are secured thereto. A black rubber layer/pad 183 rests on top of the beams 180 and the uppermost plates 181. The pad 183 is able to function as a shock absorber to reduce jarring on the blocks 32 as a train passes over them. In addition, the pad 183 is able to prevent or at least inhibit the sleepers 31 from twisting and provides continuous support between the beams 180, plates 181 and the blocks 32. Furthermore, the pad 183 is able to reduce fracturing or cracking of the blocks 32.

A pair of blocks 32 rest on top of the pad 183. The blocks 32 are similar to the block 32 depicted in FIGS. 1 to 5, except that they also include a plurality of horizontal steel rectangular/box section pipes/tubes 184 that are welded to the reinforcing frame 51 such that they extend transversely across and through the blocks 32. The tubes 84 define a plurality of rectangular/square openings 185 for water, sand or other loose material to pass through. The openings 185 supplement the round openings 78. In addition, they promote cooling of the blocks 32 and therefore the rails 110 so as to inhibit the rails 110 from being distorted by the heat they absorb from the blocks 32.

The blocks 32 are secured relative to the beams 180, plates 181, and cross braces 182 by a plurality of anchoring bolts 186 which extend through the tubes 59 as well as the beams 180 and plates 181, and by washers 187 placed over the upper ends of the bolts 186, and nuts 188 screwed on to the bolts 186.

Openings 189 are also defined by the beams 180 and plates 181. Water, sand, and other loose material can pass underneath the blocks 32 through the openings 189.

In the event that the passages or openings defined by the elevating structures 162 are filled with sand, the sand can be removed using a variety of methods without damaging the track structure 30 and without affecting train schedules. For example, the sand can be removed by vacuuming it out of the openings. A plough machine could move alongside the track and plough the sand away from the track without the machine touching and potentially causing damage to the track structure 30.

Figure 29:
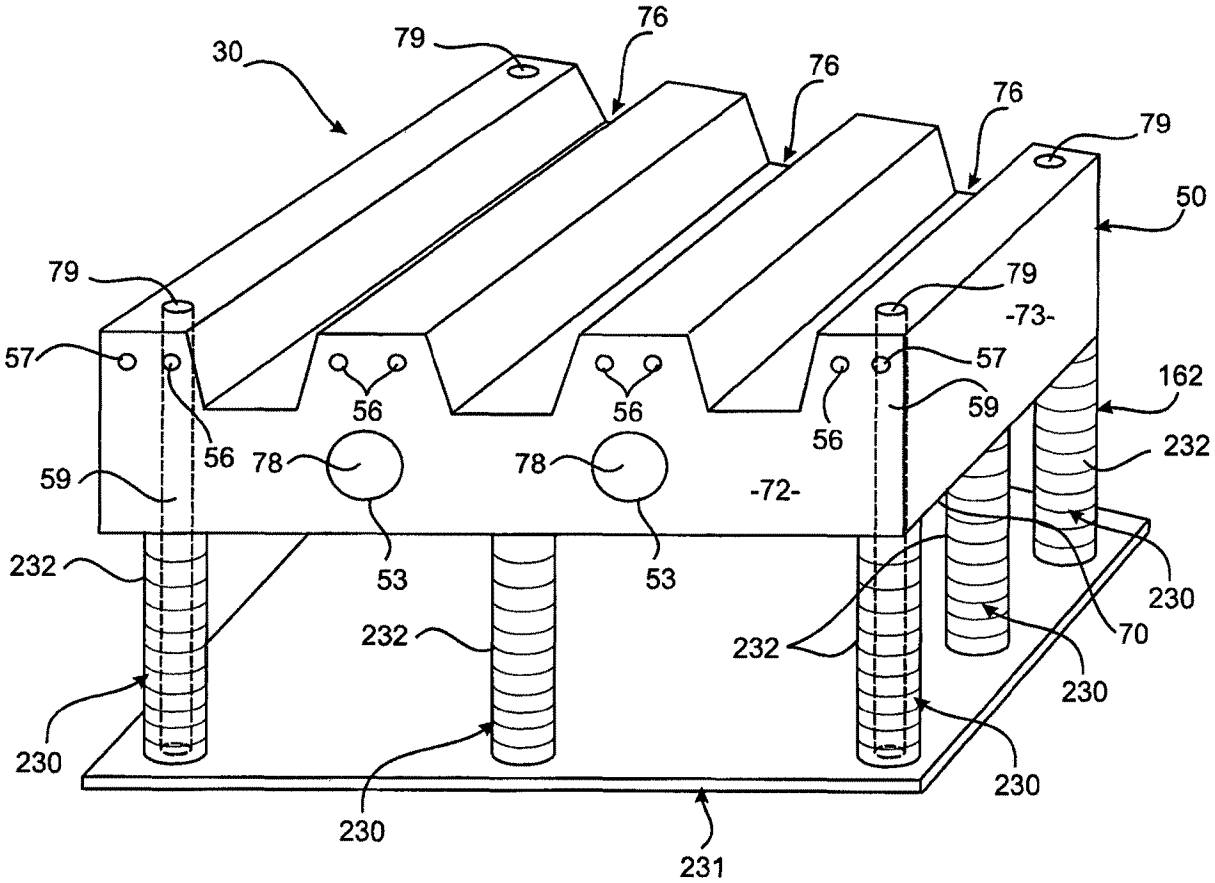
FIG. 29 depicts a portion of another railway track structure.

Referring to FIG. 29, a railway track structure 30 includes a block 32 supported by an elevating structure 162 comprising 9 cylindrical pillars/posts 230 arranged in a regular array and a thick steel plate 231. Posts 230 are secured to the plate 231 such that the posts 230 extend upwardly from the plate 231 and such that they are perpendicular relative to the plate 231. In use, the plate 231 rests on a support surface (not depicted) so that the block 32 is elevated above the support surface by the posts 230.

Each post 230 comprises a steel tube/pipe 59 which is secured at one end to the plate 231 by welding or some other suitable means. The opposite end of the pipe 59 is embedded in the concrete body 50 of the block 32 and is welded or otherwise secured to an internal reinforcing frame (not depicted) of the body 50.

Each pipe 59 defines a securing opening 79 that extends through the pipe 59 from the upper face 71 of the block 32 to the bottom of the plate 231. A suitable securing means such as, for example, a stake or lock down pin (not depicted) can be inserted into the upper end of the opening 79 and driven into the support surface upon which the plate 231 rests so that the plate 231 and the rest of the structure 30 is secured relative to the support surface.

Each post 230 also includes a reinforced concrete body 232. The pipe 59 is encased in the concrete body 232 which includes a steel reinforcing frame (not depicted) encased in concrete.

Although each post 230 can be any suitable height, in the preferred embodiment of the railway track structure depicted in FIG. 29, each post 230 is 900 mm or 1000 mm tall.

The railway track structure 30 and its elevating structure 162 depicted in FIG. 29 is able to overcome the issue/problem of the structure such as the structure 30 depicted in FIG. 20 where the block 32 rests on pipes 160 which can be readily clogged with sand or other material.

The presence of the pipes 53 in the block 32 depicted in FIG. 29 is optional. However, the presence of the pipes 53 is advantageous in that it allows air to circulate through the body 50 of the block 32 and to cool the block 32. Cooling the block 32 is able to result in less heat being transmitted from the block 32 to the rails (not depicted) which are supported on the block 32. This means that the rails are less likely to heat excessively and consequently twist, buckle, or otherwise distort.

Figure 30:
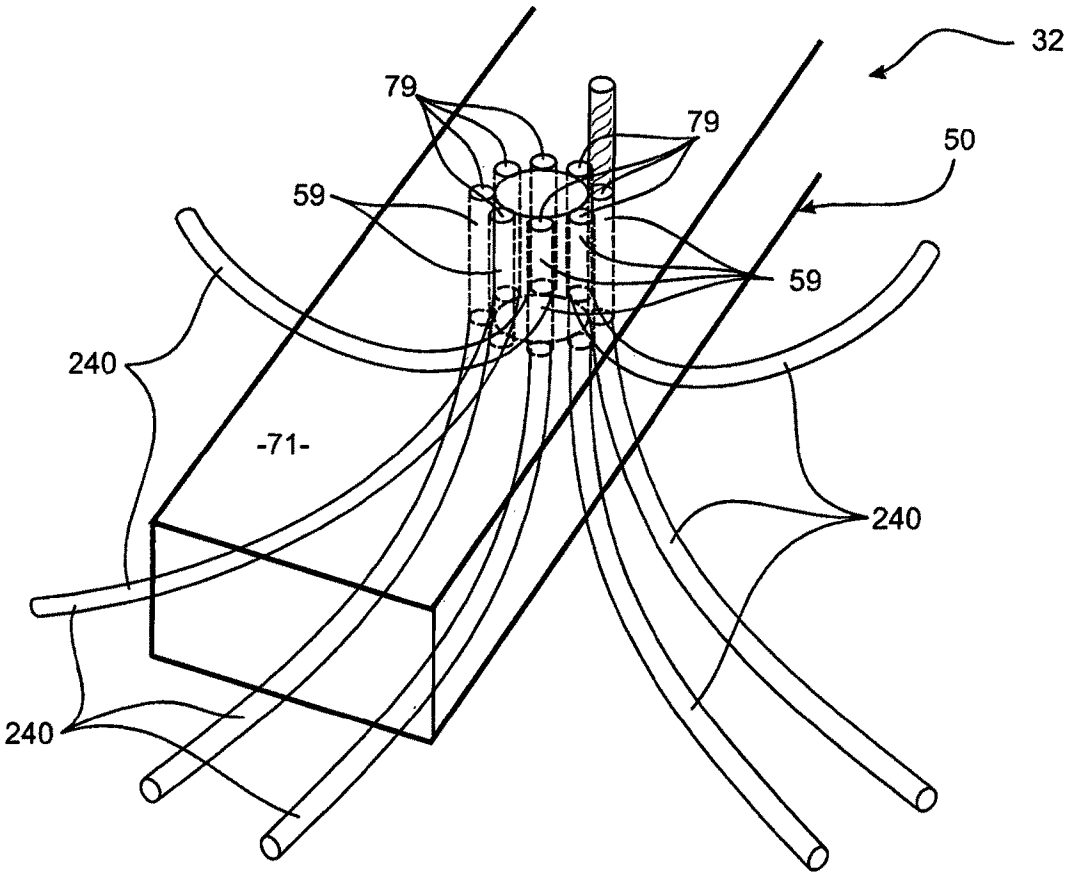
FIG. 30 depicts a portion of an alternative embodiment of a block of a railway track structure and how the block is able to be secured relative to a support surface.

Referring to FIG. 30, there is depicted a portion of a block 32 which may be similar to any of the other blocks described herein. The depicted block 32 includes a plurality of steel tubes 59 that are embedded within the concrete body 50 and that may be secured to a reinforcing frame which is also embedded within the concrete body. The tubes 59 are arranged in a conical fashion such that the tubes 59 converge towards each other at the upper face 71 of the block 32, and such that they diverge from each other at the lower face 70 of the block 32.

In use, the block 32 may rest on a support surface (not depicted), and the block 32 may be secured relative to the support surface by inserting a respective metal bar 240 into each securing opening 79 defined by each tube 59 and driving the bar 240 into the support surface. If the bar 240 is flexible, it will tend to bend in the manner shown in FIG. 30 as it is driven into the support surface.

After being inserted into the securing openings 79 and driven into the support surface, the bars 240 are arranged in a manner which is similar to the arrangement of the hooks/claws/flukes of a grappling hook. This arrangement enables the bars 240 to securely anchor the block 32 relative to the support surface.

The track structures 30 which include the elevating structures 162 are not limited to being used in sandy desert environments such as those encountered in Saudi Arabia and other Middle Eastern countries. For example, it could be used in sandy environments in Australia, regardless of whether or not they are desert environments.

The beams 180, plates 181, and cross braces 182 of the railway track structure depicted in FIG. 20 function as an elevating structure 162 which is able to elevate the blocks 32 and therefore the sleepers 31 and rails 110 above a surface of the location in which the structure 30 resides. For example, if the structure 30 is located in a sandy desert, the support 162 can elevate the blocks 32, sleepers 31, and rails 110 above the desert floor so that sand is able to pass through the openings 189 and does not cover the blocks 32 and rails 110.

Figure 21:
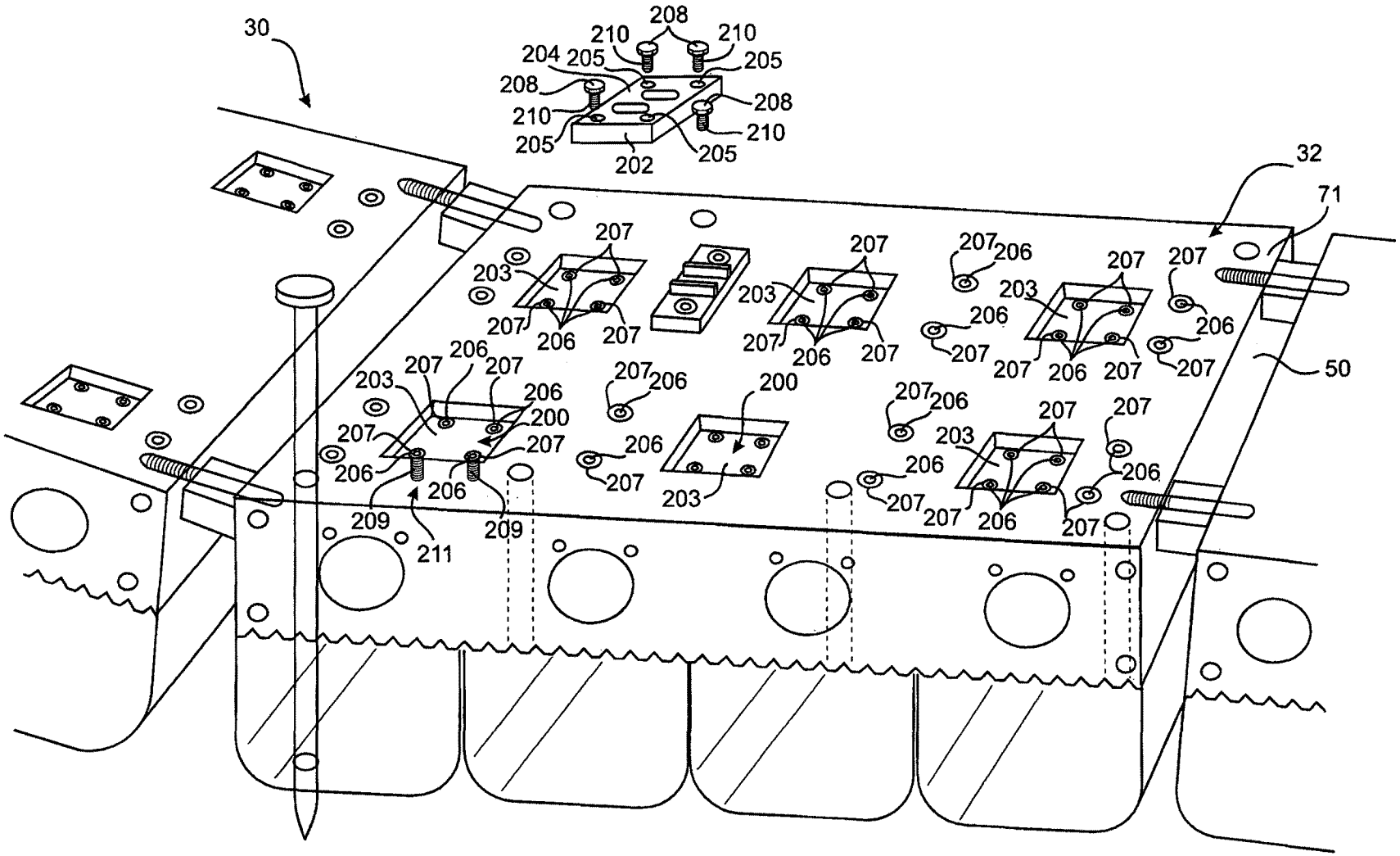
FIG. 21 is a side view of a portion of another railway track structure.
Figure 22:
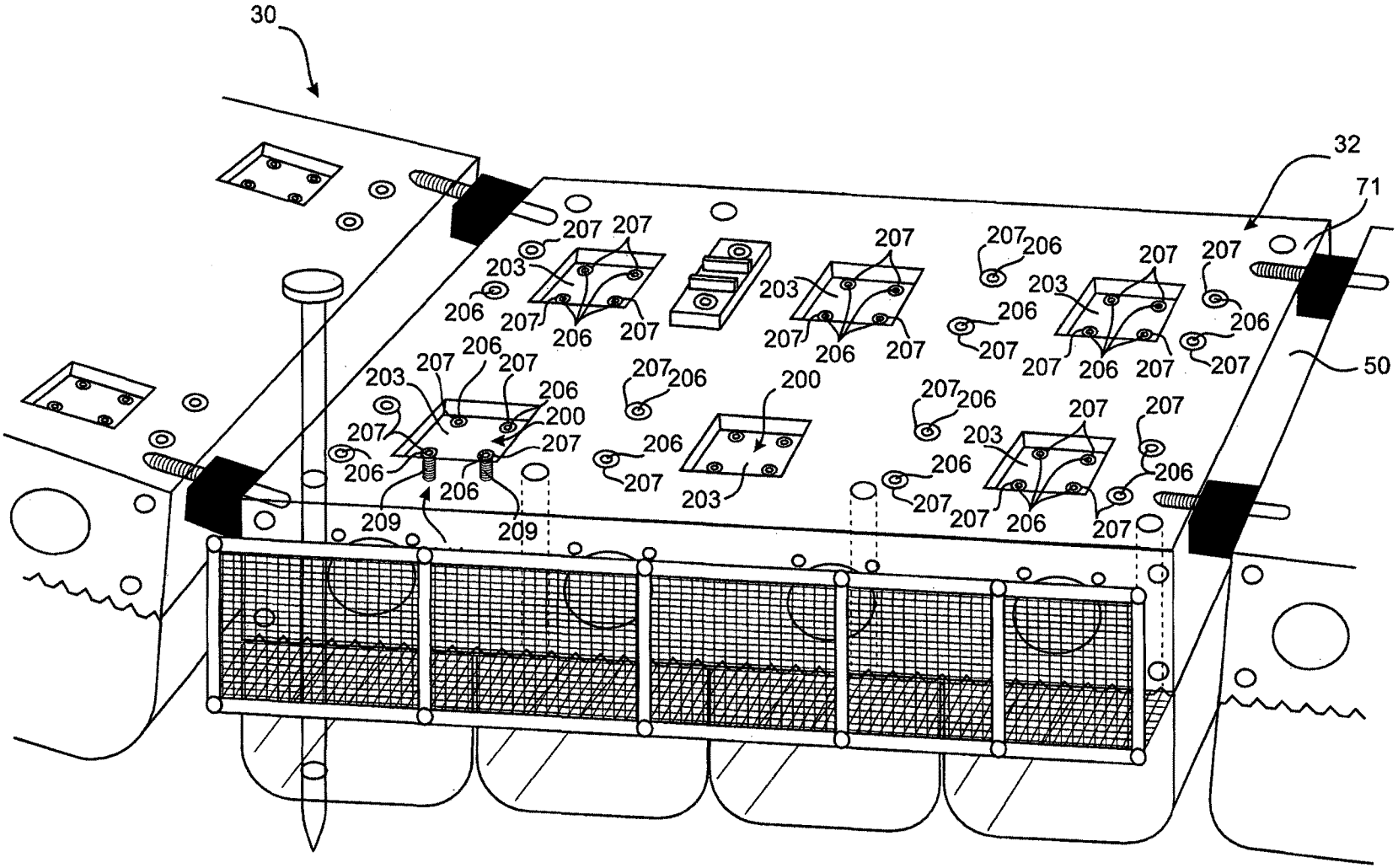
FIG. 22 is a side view of a portion of another railway track structure.

FIGS. 21 and 22 each show a portion of a railway track structure 30 that includes blocks 32 that have been positioned end to end and secured to each other.

The blocks 32 depicted in FIGS. 21 and 22 differ from those previously described in that the plurality of recesses provided on the upper face 71 of the blocks 32, rather than having the form of channels 76, comprise indented portions 200. Each of the indented portions 200 is adapted to receive a respective base plate 201 (or tie or sole plate) of a rail fastening system. Particularly, in these embodiments, the base plate 201 has a rectangular shape or profile. The indented portions 200 are complementary to the base plates 201, and are rectangularly shaped and dimensioned so that, when received in its respective indented portion 200 such that a lower face 202 of the base plate 201 rests on a bottom surface 203 of the indented portion 200, a periphery or peripheral surface or edge of the base plate 201 abuts a periphery or peripheral surface or edge of the indented portion 200, and an upper face 204 of the base plate 201 is substantially in the same plane as or flush with the upper face 71 of the block 32. Such receivement prevents or at least inhibits the base plate 201 from moving laterally or in a horizontal plane relative to the block 32—it is substantially locked in place or position in the lateral or horizontal plane. In alternative embodiments of the invention, the indented portions 200 may be more shallowly or more deeply recessed, and may be identical or differently dimensioned, so as to accommodate a wide variety of base/tie/sole or similar plates.

Each base plate 201 includes a plurality of holes or openings 205, each for receiving a respective securing member (described in further detail below) for securing or attaching the base, plate 201 to the block 32. Each base plate 201 also includes other features and elements as required for connection to other components of the rail fastening system, including clips and flanged T-rail sections, for example, as are well known to persons skilled in the art and will not be described in further detail herein except as is relevant to the present invention.

Two sets of three indented portions 200 are provided in the block 32 in these embodiments. The two sets extend longitudinally along the block 32 and parallel to each other, with the indented portions 200 positioned or spaced such that a rail (attached or fastened to the block 32 by the rail fastening system) is supported by the plate 201 as required.

A plurality of holes or bores 206 is provided extending vertically from the bottom surface 203 of each indented portion 200 into the body 50. In the embodiments, four bores 206 are provided, each located in a respective corner of the indented portion 200 so as to align with the openings 205 of the base plate 201. Each of the bores 206 defines a securing opening 207 for receiving a securing member so that a received base plate 201 is secured in the indented portion 200 and prevented or at least inhibited from moving upwardly relative thereto—allowing it to be substantially locked in place or position in the vertical plane.

In the embodiments, the securing members comprise screw spikes or rail screws 208. Any suitable screws, bolts or spikes, or other fastening may be used in alternative embodiments of the invention.

Engaging or locking means in the form of a threaded non-twist/non-screw insert 209 is provided in each of the bores 206, and shaped to threadably engage with a threaded shank portion 210 of a screw spike 208 when a screw spike 208 is applied (via a respective opening 205 in the base plate 201) to secure or lock a positioned base plate 201.

The locking means further comprises a locking member in the form of a rod 211 extending transversely across a bottom portion of each bore 206, distal or remote from the securing opening 207. In these embodiments, the rod 211 is fabricated from a suitable plastic, metal (such as steel), or fibreglass material and is set into the concrete body 50, insulated from the frame 51 thereof. On application of a screw spike 208, the threaded shank portion 210 thereof "bites" into or otherwise engages with the rod 211. Such engagement further assists in impeding removal of a screw spike 208 once applied, and thus securing a positioned base plate 201.

Prior to insertion or application of a screw spike 208 a bore 206 may be at least partially filled with or have applied to the insert 209 an adhesive, such as, for example, the adhesive marketed under the trade mark Loctite®. Such application will assist in preventing removal of a screw spike 208 once applied, and thereby further prevent removal or movement of a base plate 201 once fastened in position.

In the embodiments described, the indented portions 200 of each set are separated by a distance of 600 mm (from centre to centre). Of course, the indented portions 200 may be positioned any distance apart from each other.

Additional pairs of bores 206, having respective inserts 209 and rods 211 are provided before, between, and after the indented portions 200 of each set. These allow for fastening of additional base plates 201 and relevant components of the rail fastening system to the block 32 to provide for at least further and preferably continuous support of a rail attached thereto. The attachment of such additional supports advantageously reduces the length of rail that is not in contact with a base plate 201 (i.e. unsupported), thereby acting to further secure and strengthen the railway track structure 30.

Insulating means in the form of rubber insulator pads (not shown) may be provided between the lower face 202 of the base plate 201 and the bottom surface 203 of the indented portion 200. Such pads prevent or inhibit to at least some extent leakage from the rails and the concrete body 50 of the block 32 from being damaged from vibrations being transferred by the rails as a train passes along them.

Figure 23:
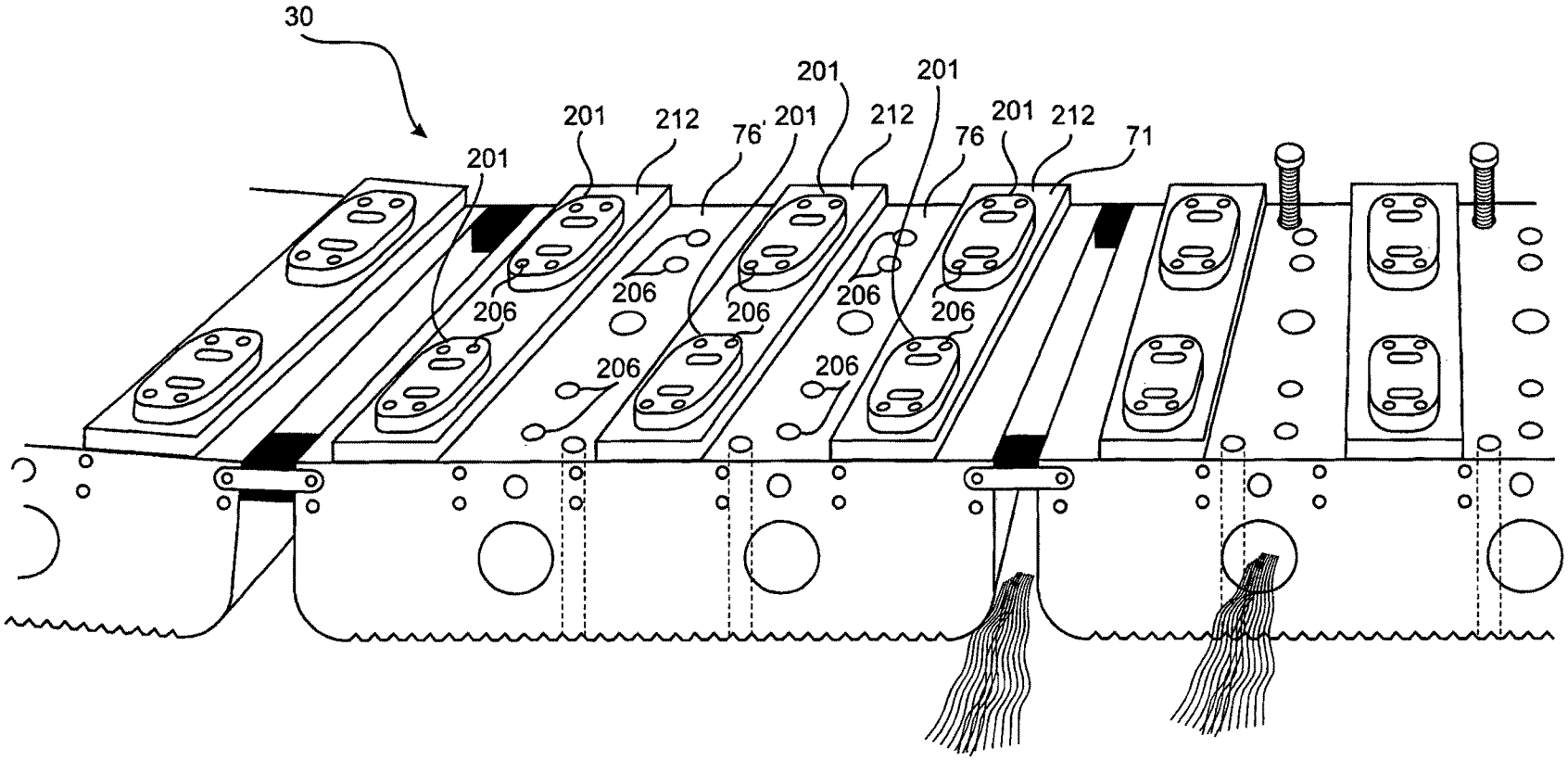
FIG. 23 is a side view of a portion of another railway track structure.

FIG. 23 shows a portion of a railway track structure 30 that includes blocks 32 that have been positioned end to end and secured to each other.

The blocks 32 depicted in FIG. 23 differ from those previously described in that raised portions or ridges 212 on the upper face 71 of the blocks 32, defined between each channel 76, are provided with pairs of bores 206, having respective inserts 209 and rods 211, as described previously. These allow for fastening of base plates 201, using appropriate securing members as described previously, and relevant components of a rail fastening system to the block 32, and are positioned or spaced such that a rail (attached or fastened to the block 32 by the rail fastening system) is supported as required by the base plates 201. In the embodiment depicted in FIG. 23, the base plates 201 comprise egg-type/shaped base plates. In alternative, embodiments of the invention, the block 32 may be provided with suitable components or otherwise adapted to facilitate attachment to components of other types of rail fastening systems using a wide variety of base/tie/sole or similar plates.

Additionally, the channels 76 of the blocks 32 of the embodiment depicted in FIG. 23 are provided with pairs of bores 206, having respective inserts 209 and rods 211, as described previously. These facilitate attachment of sleepers 31 and/or base plates 201, using appropriate securing members as described previously, and relevant components of a rail fastening system to the block 32, in the channels 76. These are also positioned or spaced such that a rail (attached or fastened to the block 32 by the rail fastening system) is supported as required. Similar to as described previously in relation to the embodiments depicted in FIGS. 21 and 22, the attachment of such additional supports advantageously reduces the length of rail that is not in contact with a base plate 201 (i.e. unsupported), thereby acting to further secure and strengthen the railway track structure 30.

Figure 31:
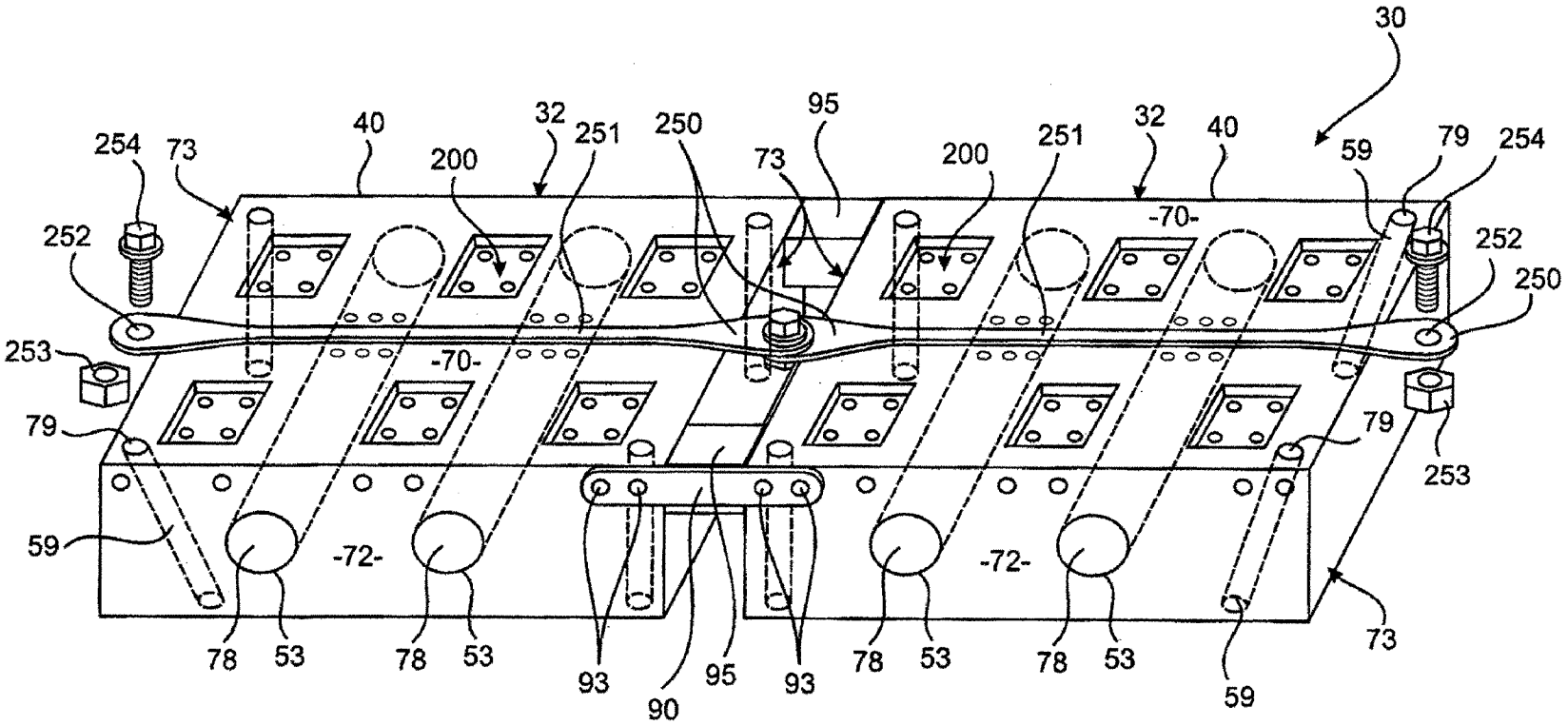
FIG. 31 depicts a portion of another railway track structure.

FIG. 31 depicts a portion of a railway track structure 30 that includes a pair of blocks 32 that are laid end to end and that are similar to those of the structure 30 depicted in FIG. 21.

The blocks 32 include galvanized pipe/tubes 59 which are inclined relative to the vertical and which therefore define inclined securing openings 79. When stakes/lockdown pins are inserted into these inclined tubes 59/securing openings 79 and driven into a support surface such as a soil support surface for example, the stakes/lockdown pins will be driven into the support surface at an angle relative to the vertical. Driving the stakes/lockdown pins into a support surface so that they are inclined relative to the vertical will provide the stakes/lockdown pins with increased/greater locking ability or grip. If the support surface is a soil support surface, driving the stakes/lockdown pins into the support surface will provide them with greater soil locking ability or grip.

Each block 32 also includes a respective distance locator bracket 250 extending from each end face 73. The brackets 250 are connected to each other by a reinforcing rod 251 which is welded to the drainage pipes 53 and to the internal reinforcing frame of the block 32. The brackets 250 and the reinforcing rod 251 are embedded in the reinforced concrete body 40 of the block 32. A hole 252 extends through each distance locator bracket 250 so that each bracket 250 can be secured to another bracket 250 of an adjacent block 32 with a nut 253 and a bolt 254. When the brackets 250 are secured together in this manner, the distance locator brackets 250 function to space the blocks 32 apart from each other by a particular distance.

Figure 24:
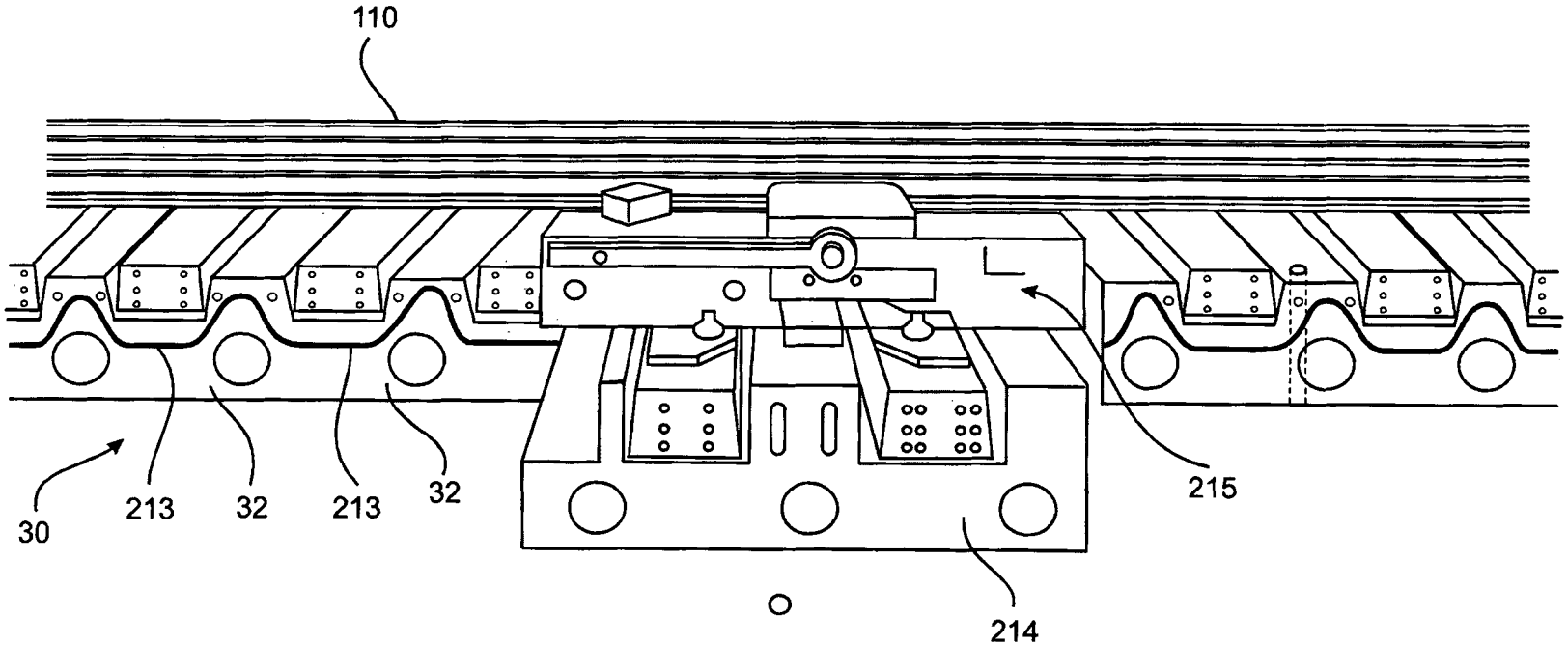
FIG. 24 is a side view of a portion of another railway track structure.

FIG. 24 shows a portion of a railway track structure 30 that includes a pair of blocks 32 that have been positioned end to end and secured to each other.

The blocks 32 depicted in FIG. 24 differ from those previously described in that heating means in the form of a pyrotechnic heating cable or element 213 is encased in the body 50 of the blocks 32, and operably coupled from one block 32 to the next. The element 213 is operable to increase the temperature of the body 50 to prevent or inhibit to at least some extent the formation of ice or frost on the rails 110 and to prevent components and apparatus associated therewith, such as switching apparatus, from freezing, sticking or locking in cold weather conditions.

FIG. 24 also depicts an embodiment of a support 214 in accordance with an aspect of the present invention. The support 214 differs from the blocks 32 previously described in that switching control apparatus 215 operable to control a railroad switch, turnout, or set of points of a railway track system is supported, rather than rails 110.

The various blocks 32, sleepers 31, and rails 110 that have been described are able to form at least part of a railway track system.

Using blocks such as the blocks 32 described above in the construction of a railway track in place of traditional ballast means that a greater proportion of unskilled workers to skilled workers can be employed to construct the track. For example, a supervisor and 3 forklift drivers may be the only workers required to lay the blocks 32 of the track structure.

In addition to requiring less labour in order to construct it, a track which includes the blocks 32 rather than ballast may be constructed more quickly than a track which utilises ballast in its construction. The inventor estimates that a track which includes the blocks 32 instead of ballast could be constructed in roughly two-thirds the time it would take to build the same track using ballast instead of the blocks 32.

The use of blocks 32 instead of ballast in the construction of a railway track also means that the track can be laid on land which is of a lower quality than is usually necessary with ballast tracks.

The various rubber pads of the structures 30 are able to dampen the vibrations experienced by the structures 30 to such an extent that the structures 30 experience less vibration than a traditional railway track structure which utilises ballast instead of the blocks 32.

Using blocks 32 in place of ballast in the construction of a railway track can reduce or even eliminate the amount of track maintenance which is required.

The blocks 32 can replace the ballast of an existing railway track structure. The ballast is simply removed and replaced with the blocks 32 which support the existing sleepers and the existing rails which are secured to the sleepers.

Where the blocks 32 are used on a railway bridge in place of ballast, there is no need for the bridge to include the previously mentioned heavy steel corrugated/channeled plates for supporting the ballast. These plates can therefore be removed from the structure of the bridge so as to reduce the dead weight which is supported by the bridge and allow trains with heavier loads to safely pass over the bridge. It has been estimated that in some cases, the dead weight of the bridge can be reduced by as much as approximately 20% by utilising the blocks 32 in place of ballast, with a similar percentage increase in the weight of trains which are consequently able to pass over the bridge. Thus, railways that operate trains on tracks which include bridges with increased load carrying capacity could take advantage of this increased capacity and increase the loads which are carried by their trains.

The channels 74 and various drainage openings, including the drainage openings 78, of the blocks 32 provide a path for water to pass through the blocks 32 so as to ease the pressure which is exerted by the water on the blocks 32, and therefore make the blocks 32 less prone or susceptible to being displaced by flood water.

In addition, the use of securing members such as stakes, pins, star pickets, or bolts to secure the blocks 32 relative to a support surface whether that support surface is bare ground or a manmade structure such as a bridge also makes the blocks 32 less prone or susceptible to being displaced by flood waters or the forces which are exerted by trains on the track structure which the blocks 32 are a part of.

The blocks 32 can be used completely in place of ballast of a railway track structure. Alternatively, they can be used to complement sections of the structure which continue to use ballast to support the sleepers of the structure. For example, the blocks 32 may only be used in sections of the track structure which are prone to being washed away by flood waters, or in sections of the structure such as corners which are subject to forces which would normally cause significant and unwanted movement of the sleepers in those sections if the sleepers were supported by ballast.

The blocks 32 can be in a flood plain configuration which includes the channels 74 on the lower face 70. Alternatively, the blocks can be in a configuration that is suitable for laying them on a bridge and that does not include the channels 74.

In swampy areas, the blocks 32 can be placed on pontoons (not depicted) to stabilise them.

The cable holder or conduit 120 may clip on to the blocks 32 for ease of installation.

A water supply pipe and/or firefighting pipe and control means may be secured relative to the blocks 32.

As previously mentioned, by attaching hoses/pipes 145 to the blocks 32, water, such as flood water, which flows through the drainage openings in the blocks 32 can be taken well away from the rail track structure 30. Obviously, the distance that the water is taken away from the structure 30 will depend on the length of the hoses/pipes 145.

As also already mentioned, the blocks 32 can be used to replace the ballast of an existing railway structure. The blocks 32 would support the sleepers 31 of the existing structure. Thus, the blocks 32 provide a cost effective way of upgrading a railway structure without having to necessarily obtain new sleepers 31.

The blocks 32 can be made wider than normal in situations where they are to be placed on soft earth and their weight must be more widely distributed than required under normal conditions.

Figure 25:
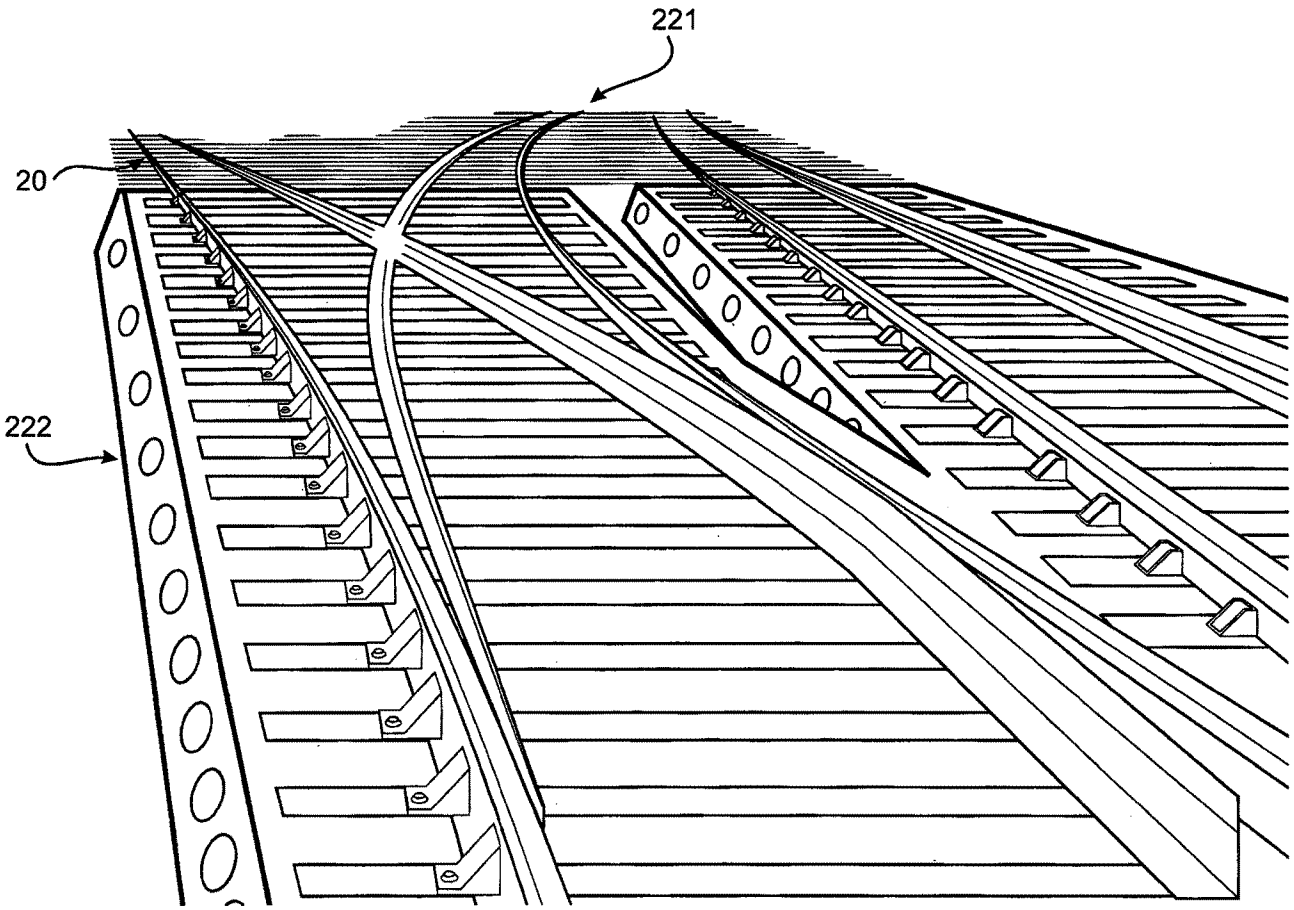
FIG. 25 is a perspective view of a portion of another railway track structure.

The blocks 32 can also be made longer (and/or wider) than normal in situations where more than one railway track is required to be supported. For example, at a railroad switch, turnout or set of points of a railway track system facilitating the guiding of trains from a first track 220 to a second track 221 at a railway junction 222 as depicted in FIG. 25, blocks 32 of a first length, for example 2.6 m, can be used to support the first track 220 and the second track 221 at locations remote from the junction 222. At locations of the first track 220 and the second track 221 proximate the junction 222, blocks 32 of increasing length may be used to support the required railway structure, increasing to a length of, for example 6.5 m, at the junction 222. Preferably, such a junction is continuously supported.

Figure 26:
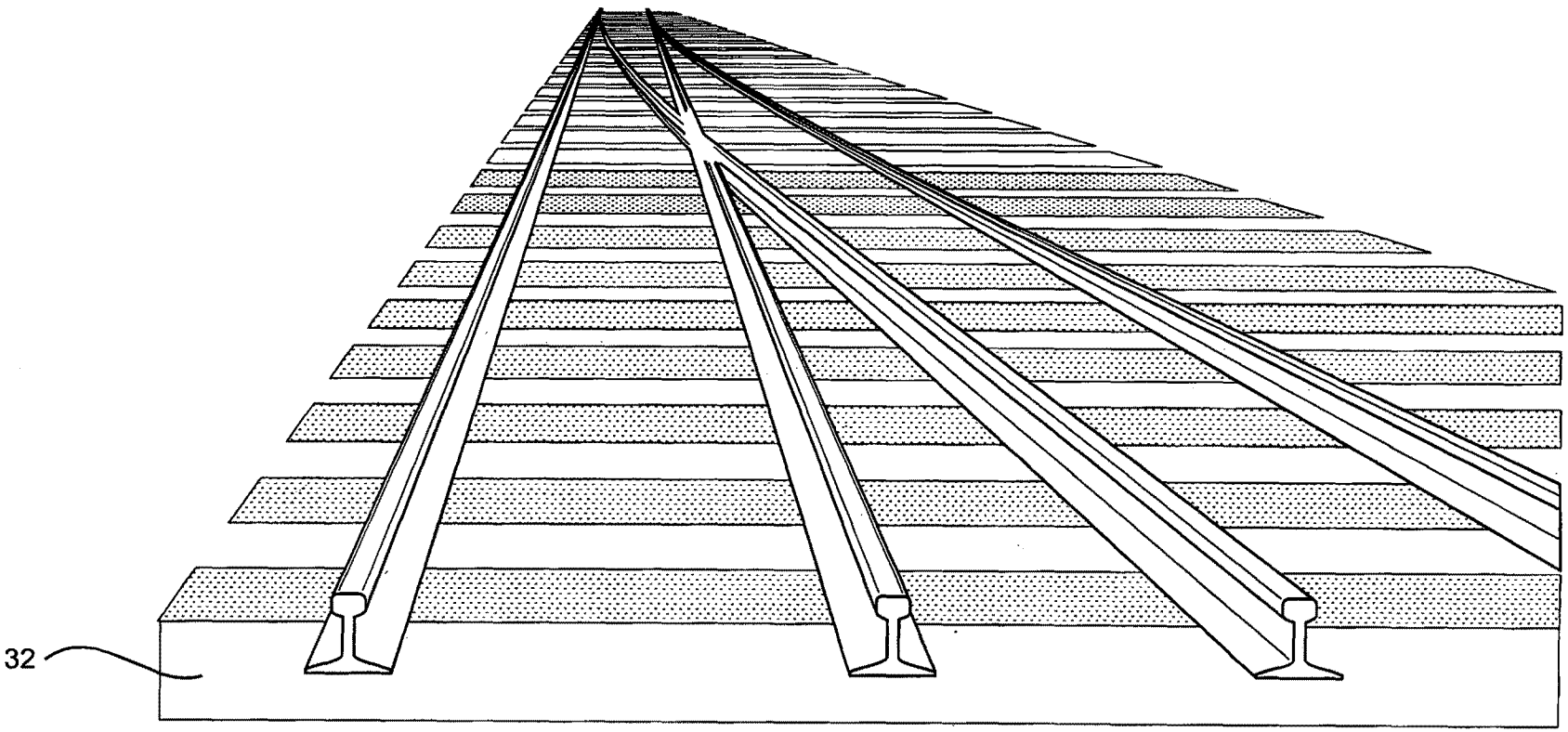
FIG. 26 is a perspective view of a portion of another railway track structure.

The blocks 32 can also be made longer so as to support, for example, two (or more) railway tracks, as depicted in FIG. 26.

The blocks 32 are not limited to being used on a particular type of railway track. They can be employed on tracks on which passenger trains primarily run, or they can be employed on tracks on which heavy freight is carried.

The blocks 32 can be reused. For example, if the track structure 30 which the blocks 32 are part of is dismantled, the blocks 32 can be used on another track structure 30 which is located elsewhere.

The cement that the bodies 50 of the blocks 32 are made is preferably a substantially white colour so as to reduce the amount of heat which is absorbed by the blocks 32.

Apart from periodic rail grinding, it is envisaged that railway track structures 30 which utilise the blocks 32 will generally not require any maintenance for a period of 10-15 years.

Usage of the blocks 32 in place of track ballast can result in less punishing use of the track.

Moreover, usage of the blocks 32 in railway track structures 30 can reduce or eliminate the need for speed restrictions as a result of, for example, damage which is sustained from flooding etc.

Lower maintenance staff levels would most likely be another consequence of employing the blocks 32 in railway track structures. This would, of course, lead to large cost savings.

Apart from rail grinders, no other track equipment would be required in order to maintain a railway track structure which employs the blocks 32 in place of traditional ballast.

Usage of the blocks 32 in place of ballast would likely lower the level of noise produced as trains move along the track structure.

If a cyclone caused silt to be deposited on a track structure which employed the blocks 32 instead of ballast, the structure could be vacuumed or ploughed, and washed down.

Trains could travel faster on railway track structures which employ the blocks 32. This would mean that trains could reach their destinations faster than if the track structures utilised traditional ballast.

Railway track structures which utilise the blocks 32 are able to carry greater loads than traditional railway track structures which employ ballast in their construction. Consequently, fewer trains can carry the same load that would normally be distributed between more trains. Fewer trains means that less train drivers are required per 24 hour shift.

Also, because fewer locomotives and wagons are required owing to the reduced number of trains that are required to run, the workshops for the locomotives and wagons can be smaller.

In addition, the spare parts inventory for the locomotives and wagons can be smaller.

Utilising the blocks 32 in railway track structures 32 can result in a reduction of problems in inclement weather such as in cyclones, hurricanes, and flooding.

Used blocks 32 can be returned to a near new condition simply by subjecting them to a high pressure wash.

It is expected that the blocks 32 will have a life expectancy of 50-75 years.

Fibre optic cable and/or IT cable can be clipped/secured to a railway structure 30 which employs the blocks 32 in place of ballast for long distances. For example, such cables could be secured relative to a structure 30 which extends from Port Headland to Mount Newman in Western Australia, a distance of 250 km, and beyond.

Water which flows through the drainage openings in the blocks 32 could be carried to other locations by 150-300 mm diameter plastic type pipe.

The greater strength and reliability of a rail structure which employs the blocks 32 when compared to traditional rail structures which employ ballast would, in at least some cases, do away with the need to employ road trains to transport mineral ore such as iron ore, bauxite, and coal as a backup.

Utilisation of the blocks 32 would also improve site safety with the train.

Level crossings could be incorporated where necessary with ease in rail track structures which employ the blocks 32.

Many slab track options and gauges are compatible with the blocks 32.

The use of the blocks in Tail track structures can do away with the need to purchase and maintain tamping machines or track regulators.

The blocks 32 are particularly suitable for use with level crossing boom gates in busy traffic areas.

Solar track lighting can be used near level crossings or bridges which utilise the blocks 32.

Signals and signs as well as other trackside equipment can be attached to the blocks 32.

Usage of the blocks 32 can result in massive financial savings as a result of reduced construction and maintenance costs compared to traditional rail track structures which utilise ballast.

In addition, usage of the blocks 32 can reduce airborne contaminants.

The railway track structures 30 which utilise the blocks 32 have a simple modular construction.

A camera track fault detection system can be used on a railway track structure which utilises the blocks 32.

Usage of the blocks 32 in the construction of a railway track structure can result in longer bearing life on locomotives and wagons which travel along the structure.

With the railway track structures 30 which utilise the blocks 32, it is easier to clean up grain around trackside silos since there is no ballast for the grain to get caught in. This means the reduction or elimination of rats from around the silos due to a lack of spilt grain as food.

The track structures 30 which utilise the blocks 32 are suitable for diesel and/or electric trains to operate on.

It is in general easier to repair the track structures 30 as opposed to track structures which utilise ballast.

Train turnarounds can be faster when the track structures 30 are used instead of traditional ballasted tracks.

The more efficient operation of the trains on the track structures 30 can lower carbon dioxide emissions by perhaps as much as one tenth.

Train loads of 3000-5000 tons per train are achievable with the track structures 30. This is the same load as approximately 50-70 road trains could carry.

The blocks 32 are able to provide high flow drainage of flood waters.

Usage of the blocks 32 in place of ballast on bridges can reduce the weight of the track on the bridges. It can also result in less maintenance being required for the bridges.

It will be appreciated by those skilled in the art that variations and modifications to the invention described herein will be apparent without departing from the spirit and scope thereof. The variations and modifications as would be apparent to persons skilled in the art are deemed to fall within the broad scope and ambit of the invention as herein set forth.

Throughout the specification and claims, unless the context requires otherwise, the word "comprise" or variations such as "comprises" or "comprising", will be understood to imply the inclusion of a stated integer or group of integers but not the exclusion of any other integer or group of integers.

Throughout the specification and claims, unless the context requires otherwise, the term "substantially" or "about" will be understood to not be limited to the value for the range qualified by the terms.

It will be clearly understood that, if a prior art publication is referred to herein, that reference does not constitute an admission that the publication forms part of the common general knowledge in the art in Australia or in any other country.

The invention claimed is:

1. A support for mounting on a support surface and for receiving a rail support member of a rail track, the support comprising a slab having two ends and two sides, the slab including an upper face and a lower face spaced apart for defining a lower slab section spacing apart the upper face from the support surface, the upper face including a plurality of protrusions extending in spaced apart relationship from one end to the other end defining at least one recess being adapted to receive the rail support member to support the rail track, and the lower face defining a planar surface extending from one end of the slab to the other end of the slab, the planar surface being adapted to abut the support surface, wherein the recess extends transversally with respect to the rail track from one side of the slab to another side of the slab and the recess is devoid of walls at each of the sides of the slab allowing flow fluid and solid material to traverse the recess transversally with respect to the rail track.

2. The support according to claim 1, wherein the slab further comprises at least one conduit adapted to allow solid material or fluid to traverse the slab.

3. The support according to claim 2, wherein the conduit is embedded in the slab.

4. The support according to claim 1, further comprising shock absorbing pads sandwiched between the rail support member and the recess.

5. The support according to claim 1, wherein the rail support member comprises a sleeper adapted to be received by the recess of the slab.

6. The support according to claim 1, wherein the lower face of the slab includes at least one channel extending from the one side of the slab to the other side of the slab.

7. The support according to claim 6, wherein the channel has a V-shaped profile.

8. The support according to claim 1, wherein the slab further comprises a securing opening for receiving a securing member so that the securing member is able to secure the support relative to the support surface.

9. The support according to claim 1, wherein the slab further comprises a distance locator bracket.

10. The support according to claim 1, wherein the support further comprises a heating means.

11. The support according to claim 1, wherein the support comprises a frame and a concrete casing, the frame being embedded in the concrete casing.

12. A rail track structure, the structure comprising a support, a rail support member supported by the support, and a rail supported by and secured relative to the rail support member, and at least one elevating structure, the at least one elevating structure being adapted to receive the support, wherein the support comprising a slab having two ends and two sides, the slab including an upper face and a lower face spaced apart for defining a lower slab section spacing apart the upper face from the elevating structure, the upper face including a plurality of protrusions extending in spaced apart relationship from one end to the other end defining at least one recess being adapted to receive the rail support member to support the rail track, and the lower face defining a planar surface extending from one end of the slab to the other end of the slab, the planar surface being adapted to abut the elevating structure, the upper face including a plurality of protrusions defining at least one recess being adapted to receive the rail support member to support the rail track, wherein the recess extends transversally with respect to the rail track from one side of the slab to another side of the slab and the recess is devoid of walls at each of the sides of the slab allowing flow fluid and solid material to traverse the recess transversally with respect to the rail track.

13. The rail track structure according to claim 12, wherein the at least one elevating structure comprises openings adapted to allow solid material or fluid to traverse the slab.

14. The rail track structure according to claim 12, wherein the at least one elevating structure comprises a plurality of pipes arranged side by side.

15. The rail track structure according to claim 12, wherein the at least one elevating structure comprises a plurality of beams arranged side by side.

16. The rail track structure according to claim 12, further comprising a plurality of supports, wherein the plurality of supports are arranged in a spaced apart relationship with respect to each other to define gaps between each pair of supports to allow solid material or fluid to traverse the gaps.

* * * * *